US009742115B2

(12) United States Patent
Matsumoto et al.

(10) Patent No.: US 9,742,115 B2
(45) Date of Patent: Aug. 22, 2017

(54) CONNECTOR

(71) Applicant: Yazaki Corporation, Tokyo (JP)

(72) Inventors: Yusuke Matsumoto, Shizuoka (JP); Nobuyuki Sakamoto, Shizuoka (JP); Akihiro Tsuruta, Shizuoka (JP); Nobuyuki Mukoujima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/379,161

(22) Filed: Dec. 14, 2016

(65) Prior Publication Data

US 2017/0170602 A1 Jun. 15, 2017

(30) Foreign Application Priority Data

Dec. 15, 2015 (JP) ..... 2015-244085

(51) Int. Cl.

| | |
|---|---|
| ***H01R 13/627*** | (2006.01) |
| ***H01R 13/639*** | (2006.01) |
| ***H01R 13/641*** | (2006.01) |
| ***H01R 13/05*** | (2006.01) |
| ***H01R 13/11*** | (2006.01) |
| ***H01R 24/20*** | (2011.01) |
| ***H01R 24/28*** | (2011.01) |
| ***H01R 13/52*** | (2006.01) |
| *H01R 103/00* | (2006.01) |

(52) U.S. Cl.

CPC ..... *H01R 13/639* (2013.01); *H01R 13/057* (2013.01); *H01R 13/114* (2013.01); *H01R 13/5219* (2013.01); *H01R 13/6272* (2013.01); *H01R 13/641* (2013.01); *H01R 24/20* (2013.01); *H01R 24/28* (2013.01); *H01R 2103/00* (2013.01)

(58) Field of Classification Search

CPC ..... H01R 24/20; H01R 24/28; H01R 2103/00
USPC ..... 439/352–354, 357, 358
See application file for complete search history.

(56) References Cited

U.S. PATENT DOCUMENTS 9,142,919 B2 * 9/2015 Osada ..... H01R 13/6272
2013/0210266 A1 8/2013 Osada et al.

FOREIGN PATENT DOCUMENTS

JP 2012-64461 A 3/2012

* cited by examiner

*Primary Examiner* — Javaid Nasri
(74) *Attorney, Agent, or Firm* — Kenealy Vaidya LLP

(57) ABSTRACT

A connector includes a first housing including a first lock part, a second housing including a second lock part that can be locked to the first lock part, and a fitting detection member that can move from an initial position to a fitting assured position with the second lock part locked to the first lock part and includes a third lock part that can ride over the first lock part and the second lock part in succession along with the movement from the initial position to the fitting assured position to be locked to the second lock part at the fitting assured position. The first lock part includes a drawing slope surface inclining from a protruding tip toward a first lock face and a protrusion protruding from the drawing slope surface. The second lock part includes a notch that can house the protrusion.

7 Claims, 18 Drawing Sheets

CONNECTOR

CROSS-REFERENCE TO RELATED APPLICATION(S)

The present application claims priority to and incorporates by reference the entire contents of Japanese Patent Application No. 2015-244085 filed in Japan on Dec. 15, 2015.

BACKGROUND OF THE INVENTION

1. Field of the Invention

The present invention relates to a connector.

2. Description of the Related Art

Japanese Patent Application Laid-open No. 2012-064461 discloses a half-fit preventing connector, as a conventional connector used for wire harnesses or the like, including a male connector, a female connector, and a CPA as a fitting assuring member slidably mounted on the outside of the female connector, for example. In the half-fit preventing connector, the male connector includes a male beak, a short spring, and a terminal, whereas the female connector includes a female lock that rides over the male beak and a short circuit release plate to be inserted into between the short spring and the terminal. This half-fit preventing connector forms a drawing slope surface at the tip of the male beak, thereby causing the female lock to gain a thrust on the drawing slope surface, which reduces the insertion force of the short circuit release plate.

In the half-fit preventing connector described in Japanese Patent Application Laid-open No. 2012-064461, when the CPA is slid to cause a CPA lock included in the CPA to ride over the male beak and the female lock in succession, for example, the CPA lock is once fit into between the male beak and the female lock, whereby operation feeling may degrade, leaving room for further improvement in this point.

SUMMARY OF THE INVENTION

The present invention has been made in view of the above circumstances, and an object thereof is to provide a connector that can reduce the degradation of operation feeling.

In order to achieve the above mentioned object, a connector according to one aspect of the present invention includes a first housing provided with a first terminal and including a first lock part formed to protrude from an outer face; a second housing provided with a second terminal to be connected to the first terminal, configured to be capable of being fit into the first housing, and including a second lock part capable of riding over the first lock part to be locked to the first lock part while being fit into the first housing; and a fitting detection member assembled to the second housing, being capable of moving from an initial position to a fitting assured position with the second lock part locked to the first lock part, and including a third lock part capable of riding over the first lock part and the second lock part locked to the first lock part in succession along with the movement from the initial position to the fitting assured position to be locked to the second lock part at the fitting assured position, wherein the first lock part includes a first lock face locking the second lock part, a drawing slope surface inclining from a side of a protruding tip toward a side of the first lock face, and a protrusion protruding from the drawing slope surface, and the second lock part includes a guide part facing the first lock part when the second lock part rides on the first lock part, and a notch that is formed in a recessed shape in the guide part and is capable of housing the protrusion.

According to another aspect of the present invention, in the connector, it is possible to configure that the protrusion protrudes within a space formed between the protruding tip of the first lock part, the drawing slope surface, and the second lock part with the second lock part locked to the first lock part.

According to still another aspect of the present invention, in the connector, it is possible to configure that the second lock part includes a second lock face to be locked to the first lock face of the first lock part, and the notch is formed along a direction of relative movement of the first lock part and the second lock part when the second lock part rides over the first lock part, extends up to the second lock face, and avoids contact between the second lock part and the protrusion along with the relative movement of the first lock part and the second lock part.

According to still another aspect of the present invention, in the connector, it is possible to configure that the third lock part comes into contact with the second lock part and is regulated movement thereof from the initial position to the fitting assured position with the second lock part not being locked to the first lock part, and rides on the first lock part to be able to move from the initial position to the fitting assured position with the second lock part being locked to the first lock part.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes an embodiment according to the present invention in detail based on the accompanying drawings. This embodiment does not limit this invention. Components in the following embodiment include components that can be replaced by those skilled in the art and are easily implemented or substantially the same components.

Embodiment

Figure 5:
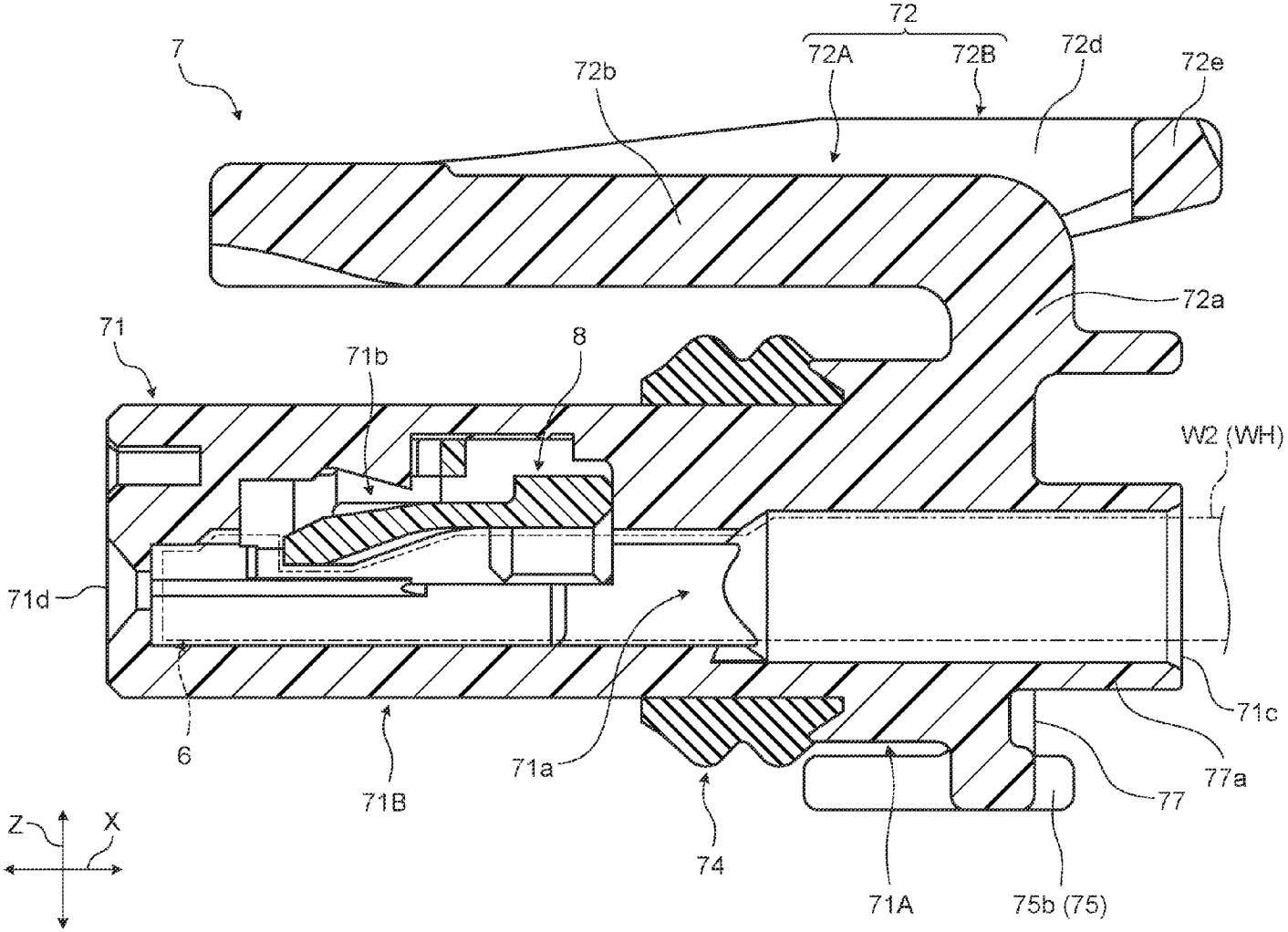
FIG. 5 is a sectional view in an axial direction and a height direction of a female housing included in the connector according to the embodiment.
Figure 6:
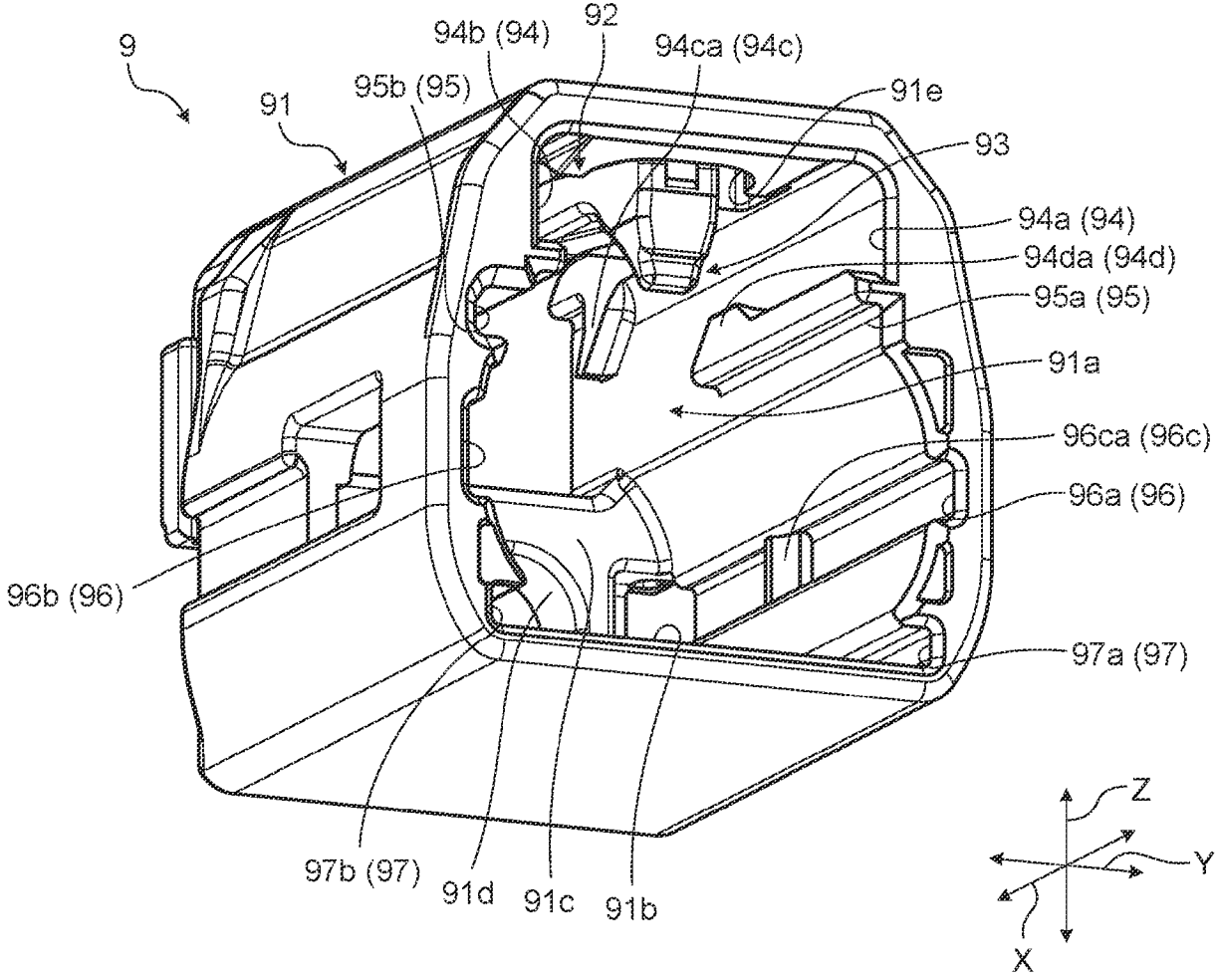
FIG. 6 is a perspective view of a schematic configuration of a CPA member included in the connector according to the embodiment.
Figure 7:
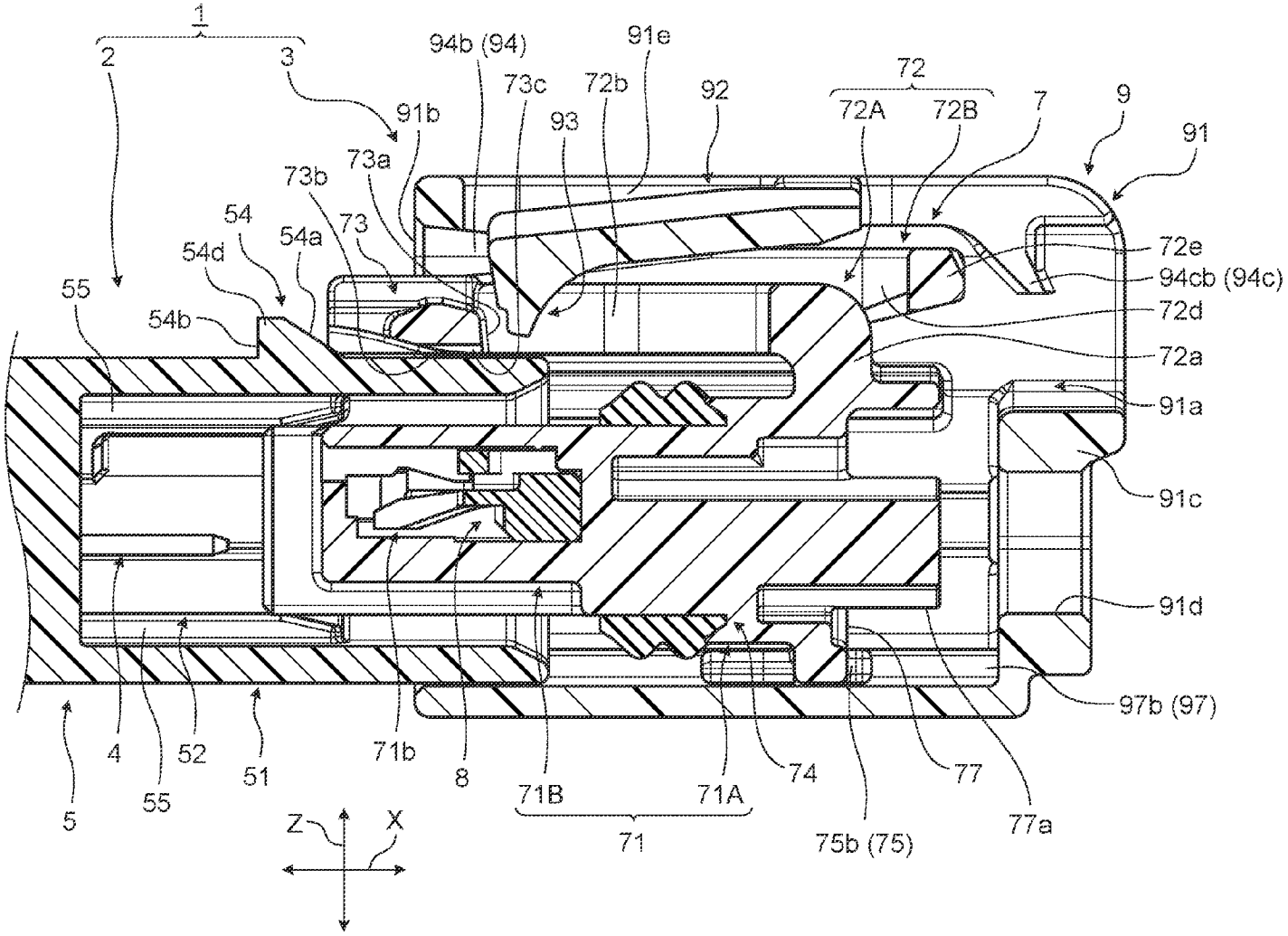
FIG. 7 is a sectional view in the axial direction and the height direction of the female housing included in the connector according to the embodiment.
Figure 8:
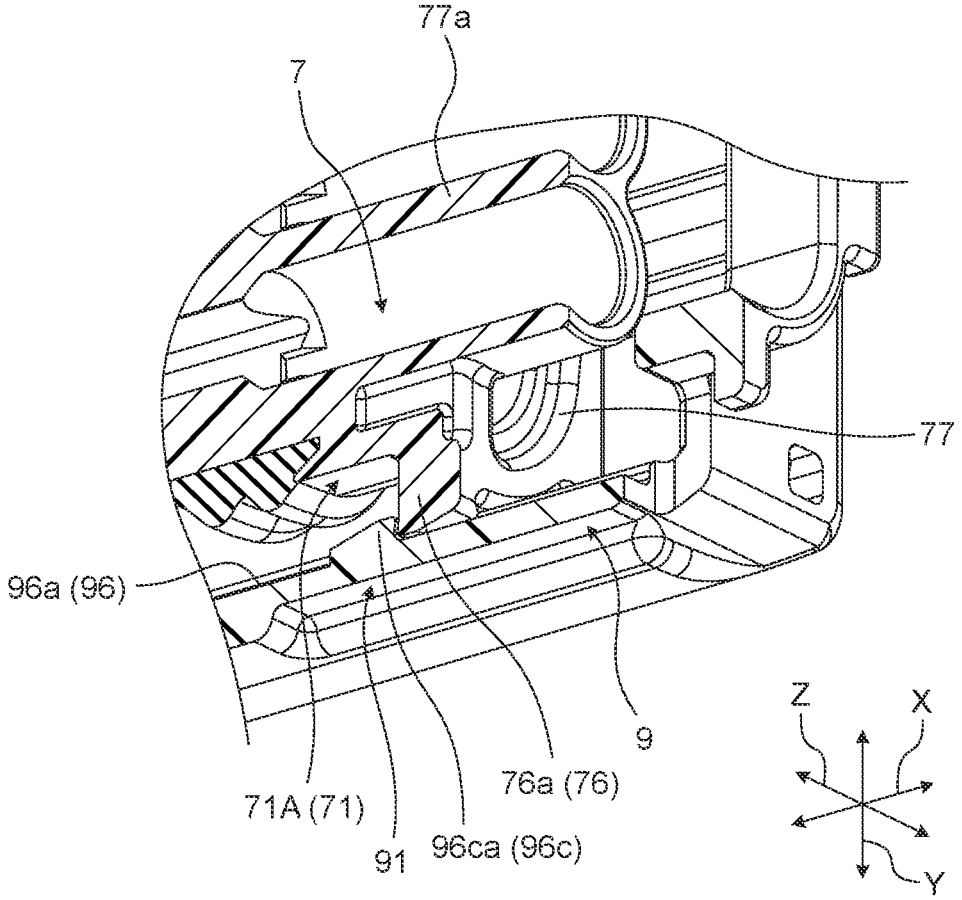
FIG. 8 is a partial sectional perspective view including a regulating protrusion included in the connector according to the embodiment.
Figure 9:
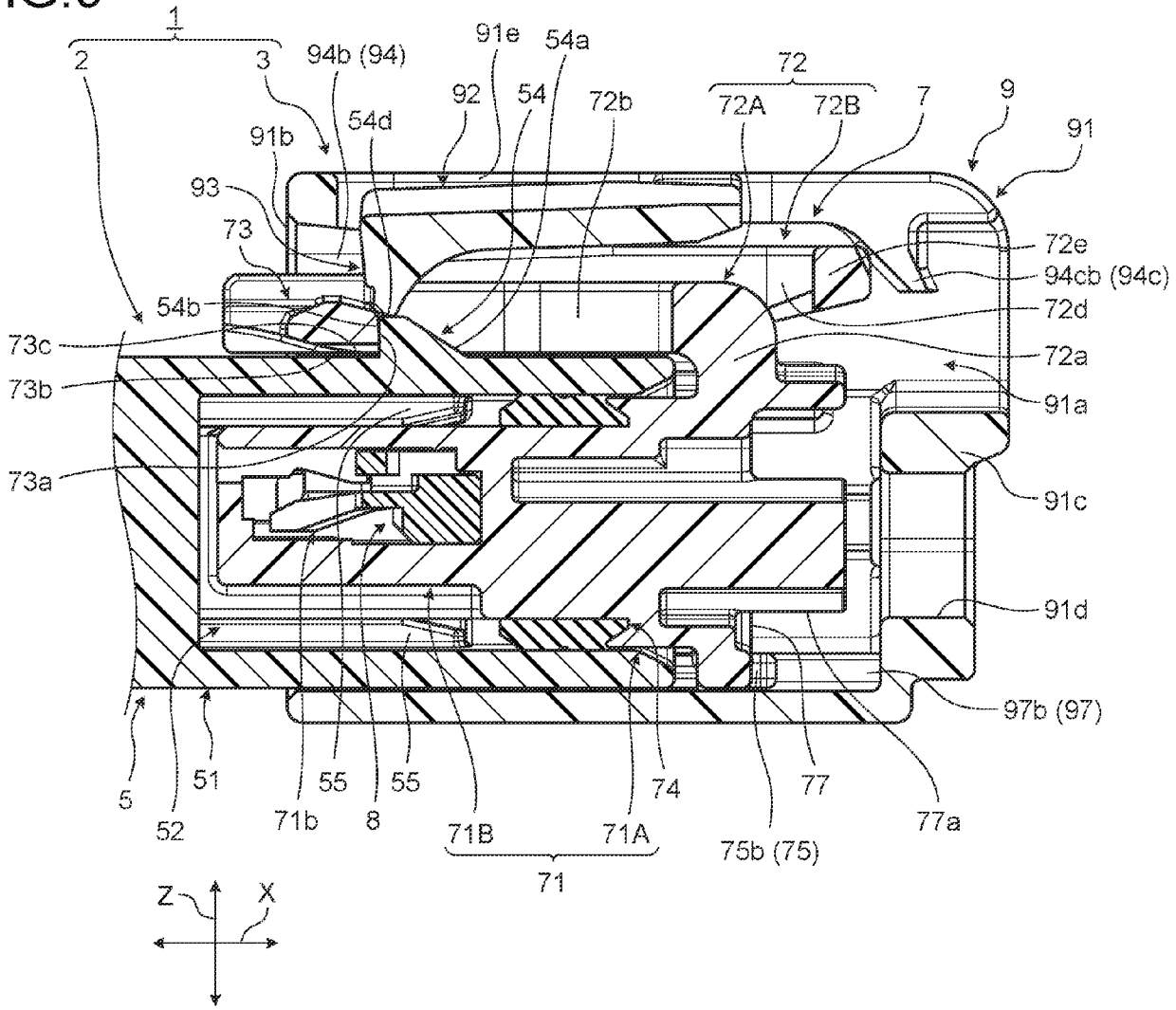
FIG. 9 is a sectional view in the axial direction and the height direction of the female housing included in the connector according to the embodiment.
Figure 10:
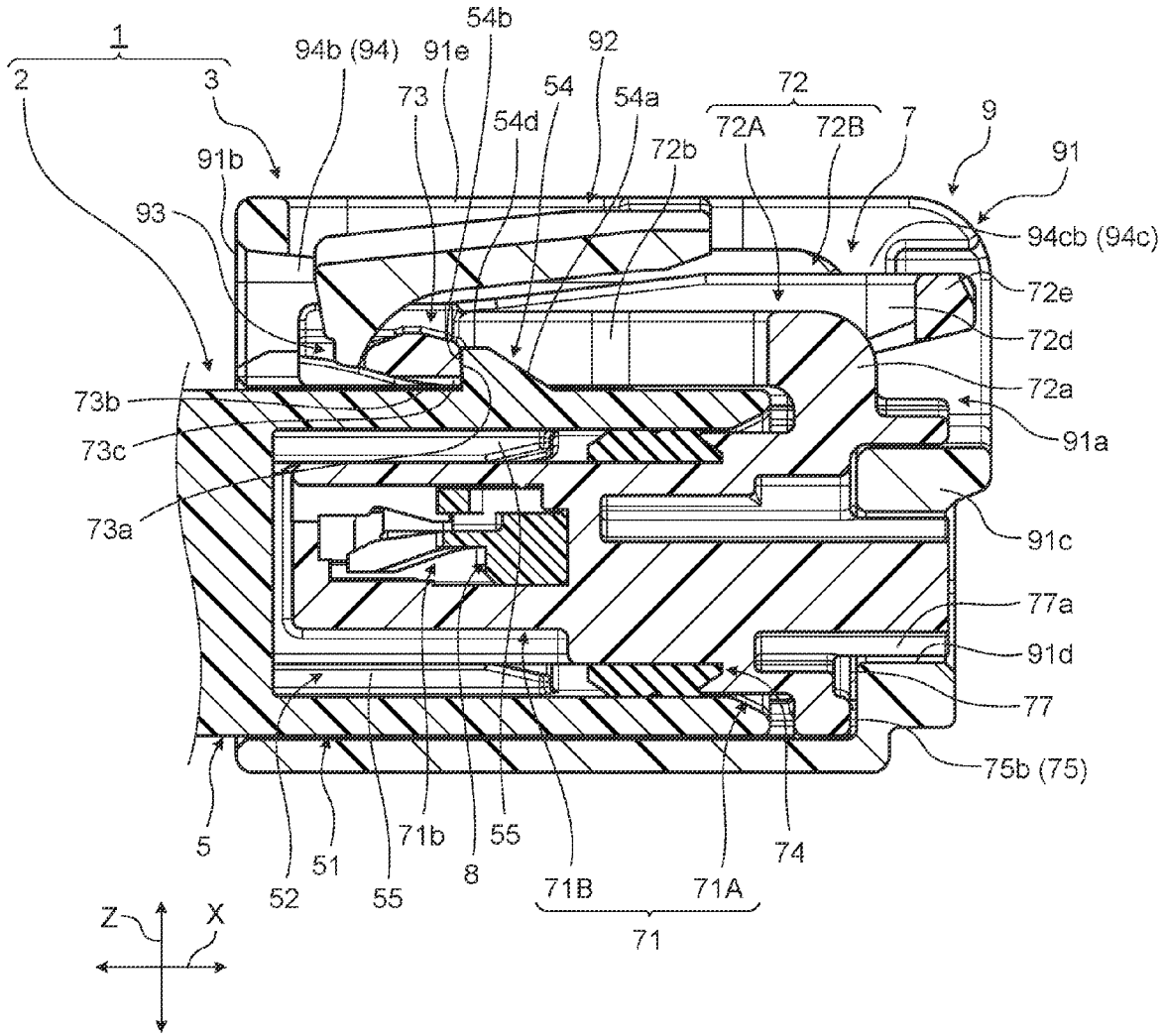
FIG. 10 is a sectional view in the axial direction and the height direction of the female housing included in the connector according to the embodiment.
Figure 11:
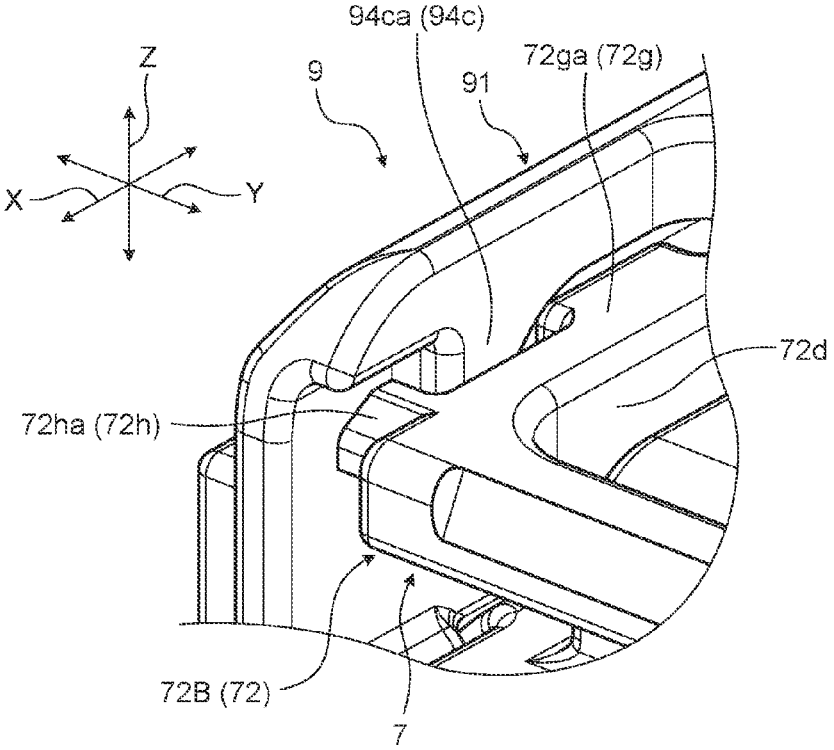
FIG. 11 is a partial sectional perspective view including a lock protrusion included in the connector according to the embodiment.
Figure 12:
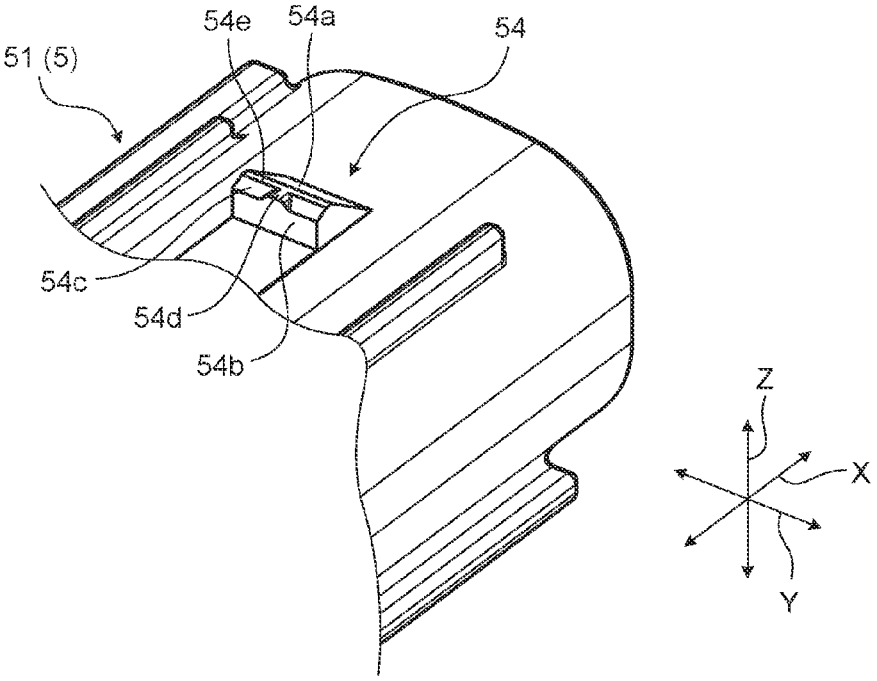
FIG. 12 is a partial perspective view including a male beak included in the connector according to the embodiment.
Figure 13:
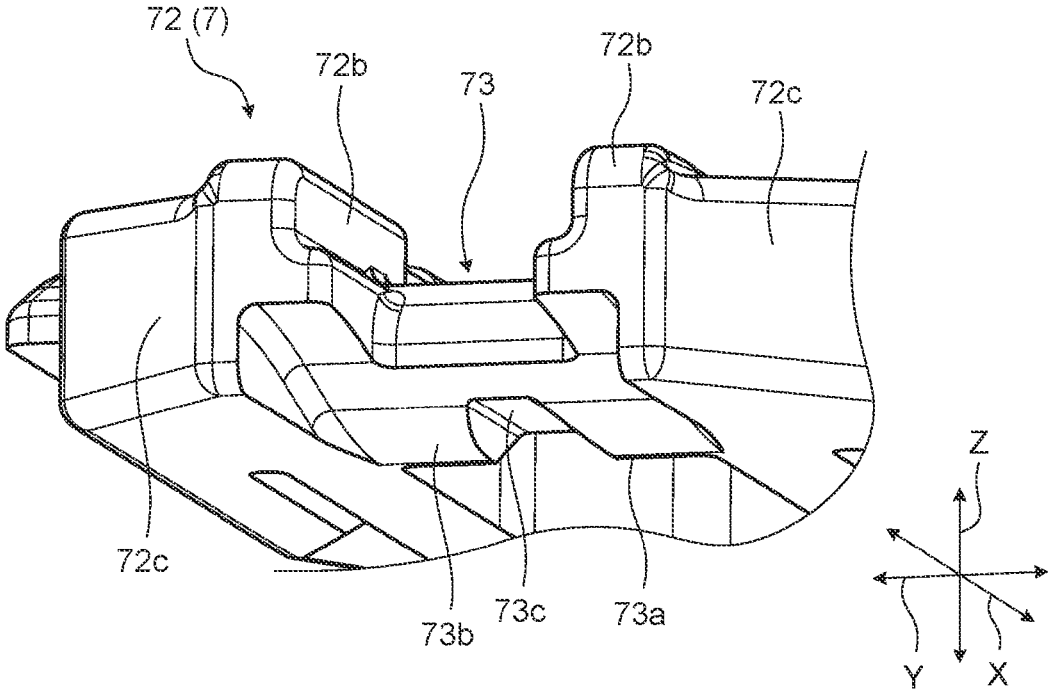
FIG. 13 is a partial perspective view including a female lock part included in the connector according to the embodiment.
Figure 17:
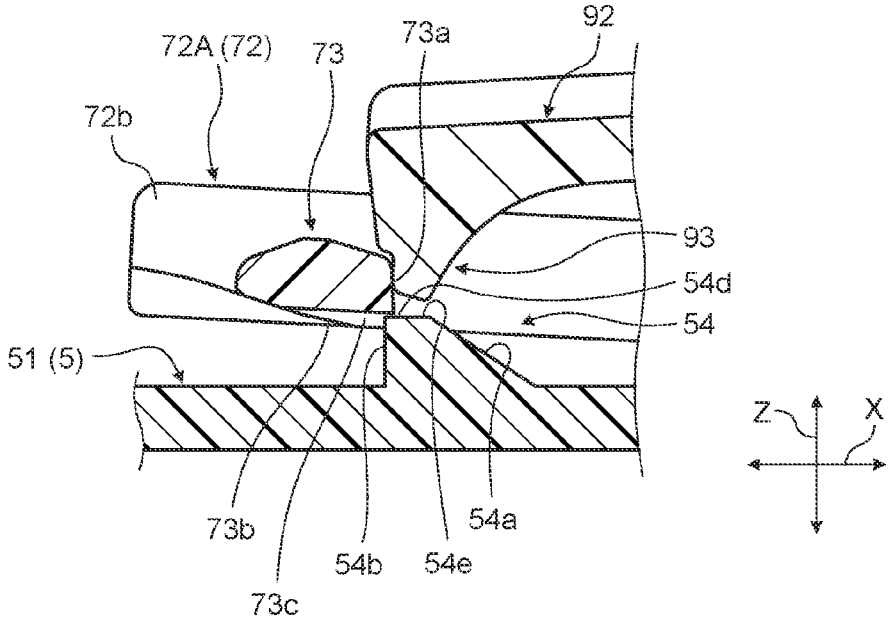
FIG. 17 is a partial sectional view including the male beak, the female lock part, and the CPA lock part included in the connector according to the embodiment.
Figure 18:
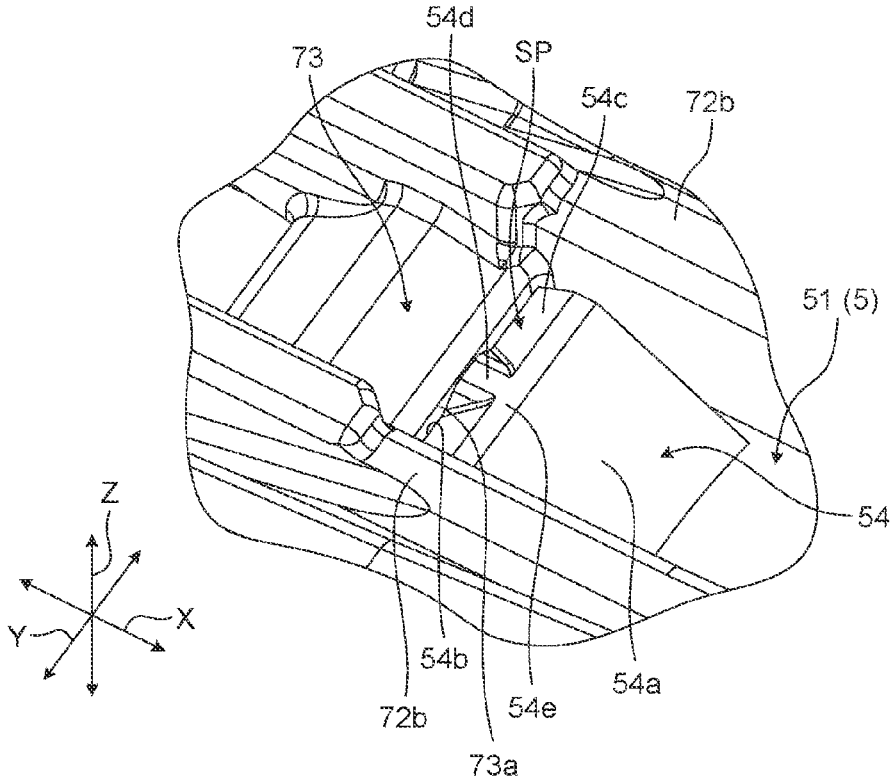
FIG. 18 is a partial perspective view including the male beak and the female lock part included in the connector according to the embodiment.
Figure 20:
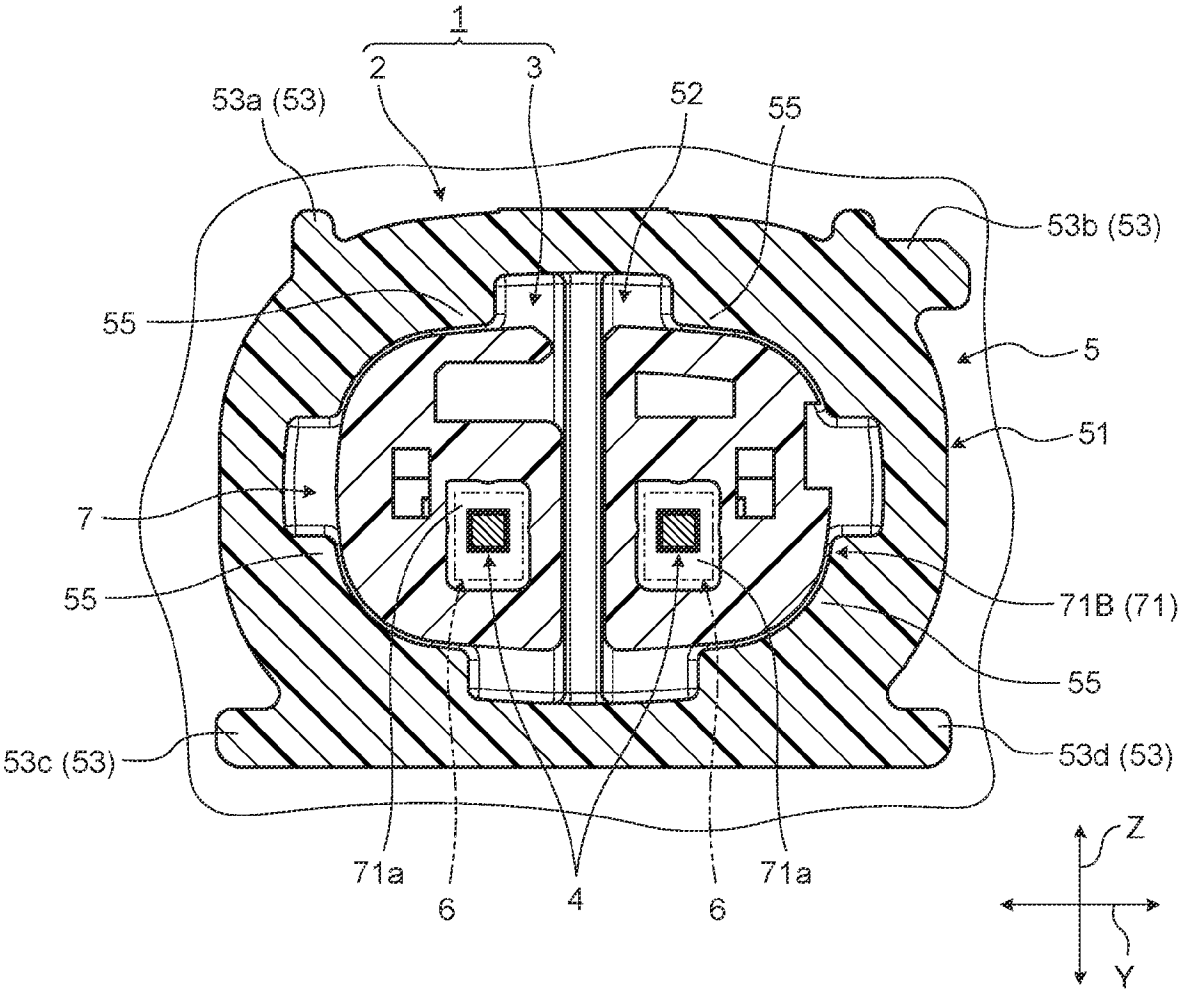
FIG. 20 is a sectional view in a width direction and the height direction including a backlash eliminating rib part included in the connector according to the embodiment.
Figure 21:
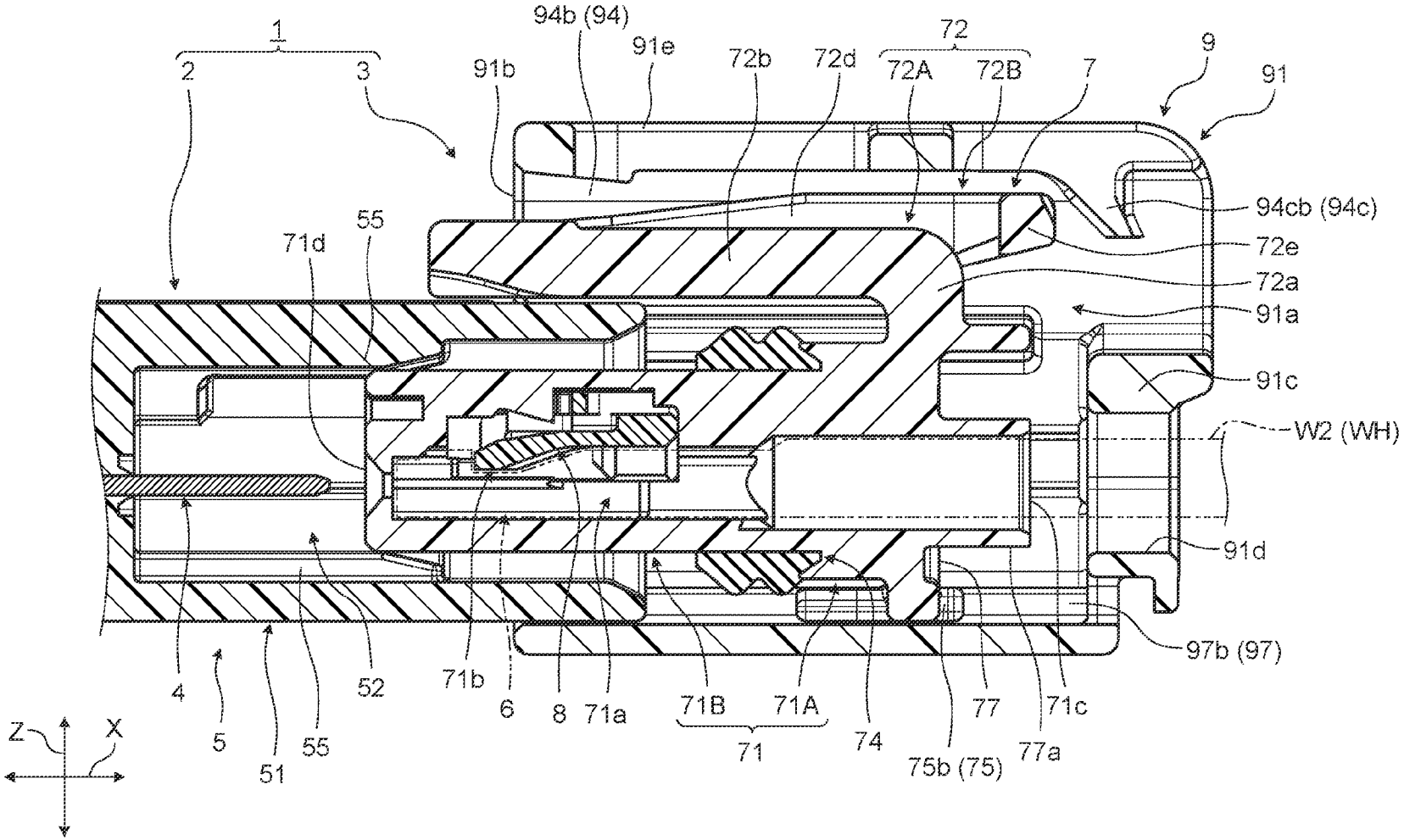
FIG. 21 is a sectional view in the axial direction and the height direction including the backlash eliminating rib part included in the connector according to the embodiment.
Figure 22:
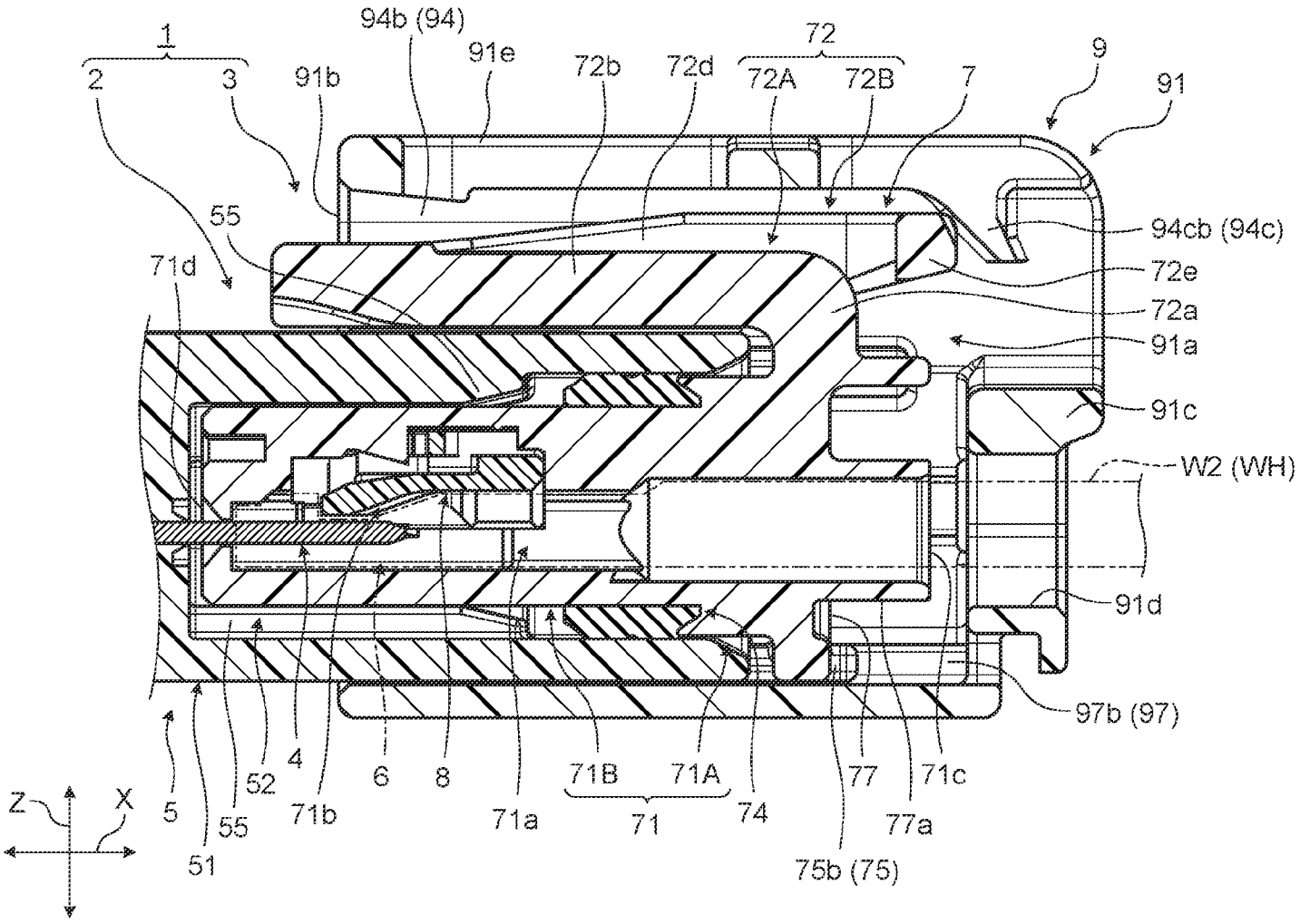
FIG. 22 is a sectional view in the axial direction and the height direction including the backlash eliminating rib part included in the connector according to the embodiment.

FIG. 1, FIG. 2, FIG. 3, and FIG. 4 are exploded perspective views of a schematic configuration of a connector according to the embodiment. FIG. 5 is a sectional view in an axial direction and a height direction of a female housing included in the connector according to the embodiment. FIG. 6 is a perspective view of a schematic configuration of a CPA member included in the connector according to the embodiment. FIG. 7, FIG. 9, and FIG. 10 are sectional views in the axial direction and the height direction of the female housing included in the connector according to the embodiment. FIG. 8 is a partial sectional perspective view including a regulating protrusion included in the connector according to the embodiment. FIG. 11 is a partial sectional perspective view including a lock protrusion included in the connector according to the embodiment. FIG. 12 is a partial perspective view including a male beak included in the connector according to the embodiment. FIG. 13 is a partial perspective view including a female lock part included in the connector according to the embodiment. FIG. 14, FIG. 15, FIG. 16, FIG. 17, and FIG. 19 are partial sectional views including the male beak, the female lock part, and a CPA lock part included in the connector according to the embodiment. FIG. 18 is a partial perspective view including the male beak and the female lock part included in the connector according to the embodiment. FIG. 20 is a sectional view in a width direction and the height direction including a backlash eliminating rib part included in the connector according to the embodiment. FIG. 21 and FIG. 22 are sectional views in the axial direction and the height direction including the backlash eliminating rib part included in the connector according to the embodiment.

Figure 1:
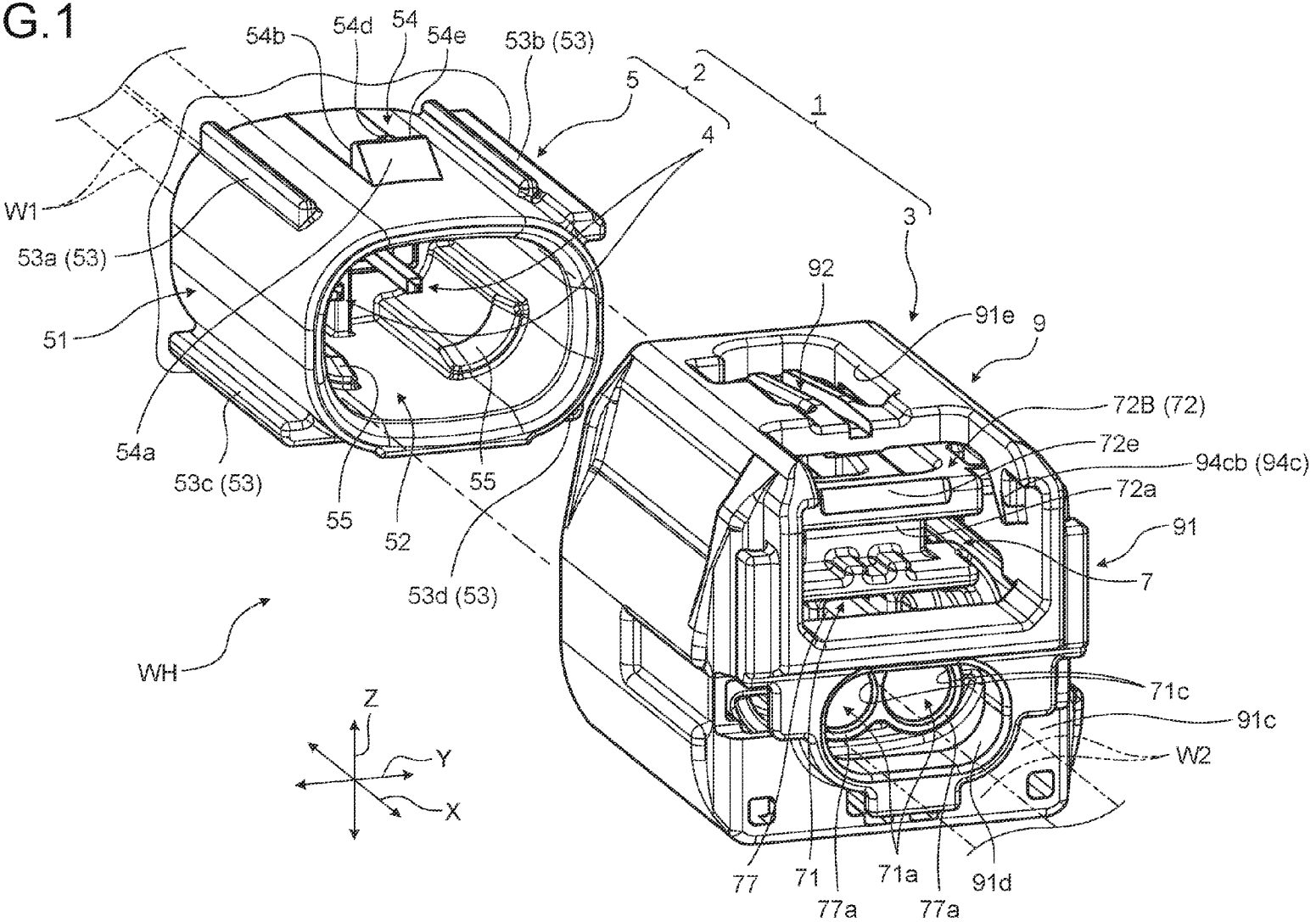
FIG. 1 is an exploded perspective view of a schematic configuration of a connector according to an embodiment.
Figure 2:
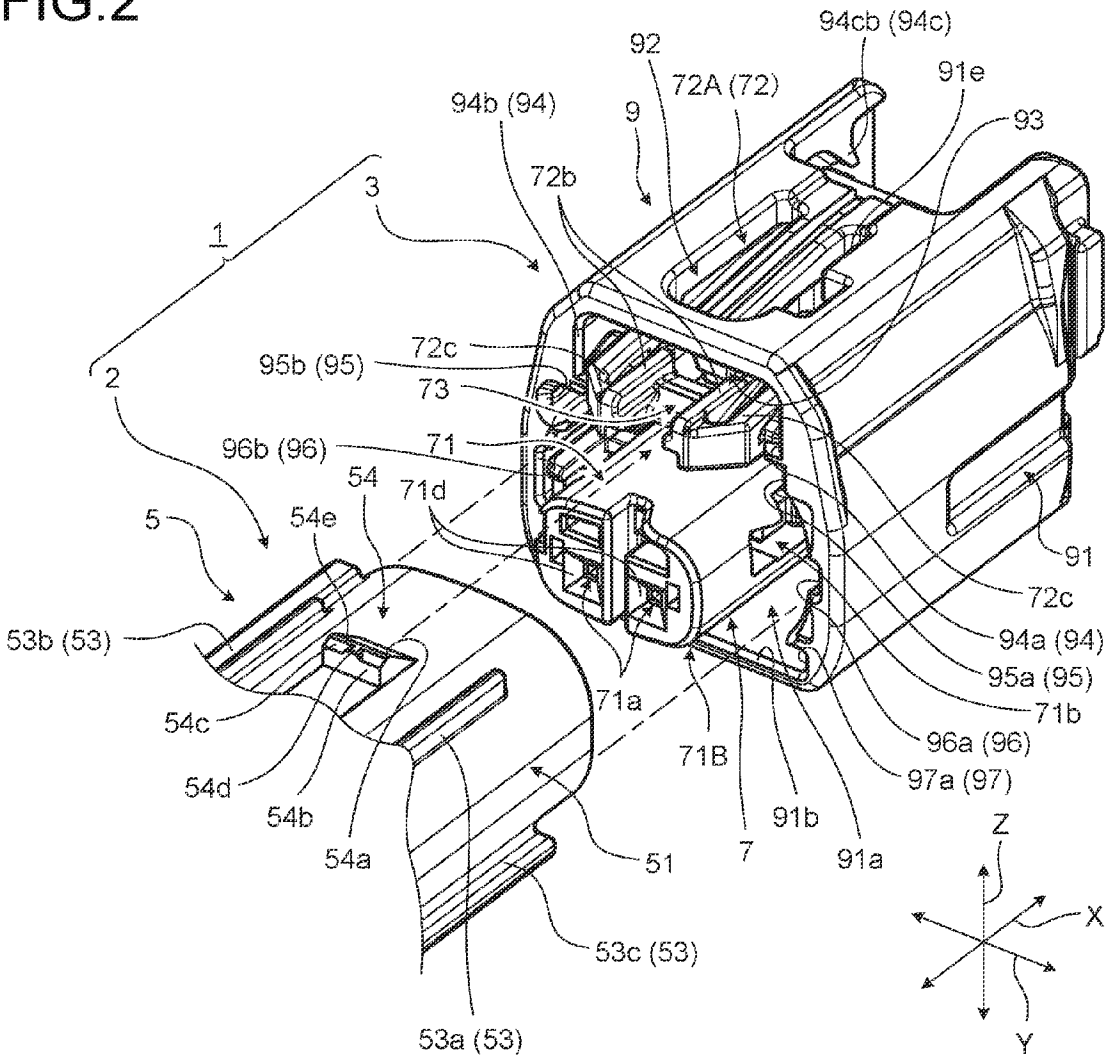
FIG. 2 is an exploded perspective view of the schematic configuration of the connector according to the embodiment.
Figure 3:
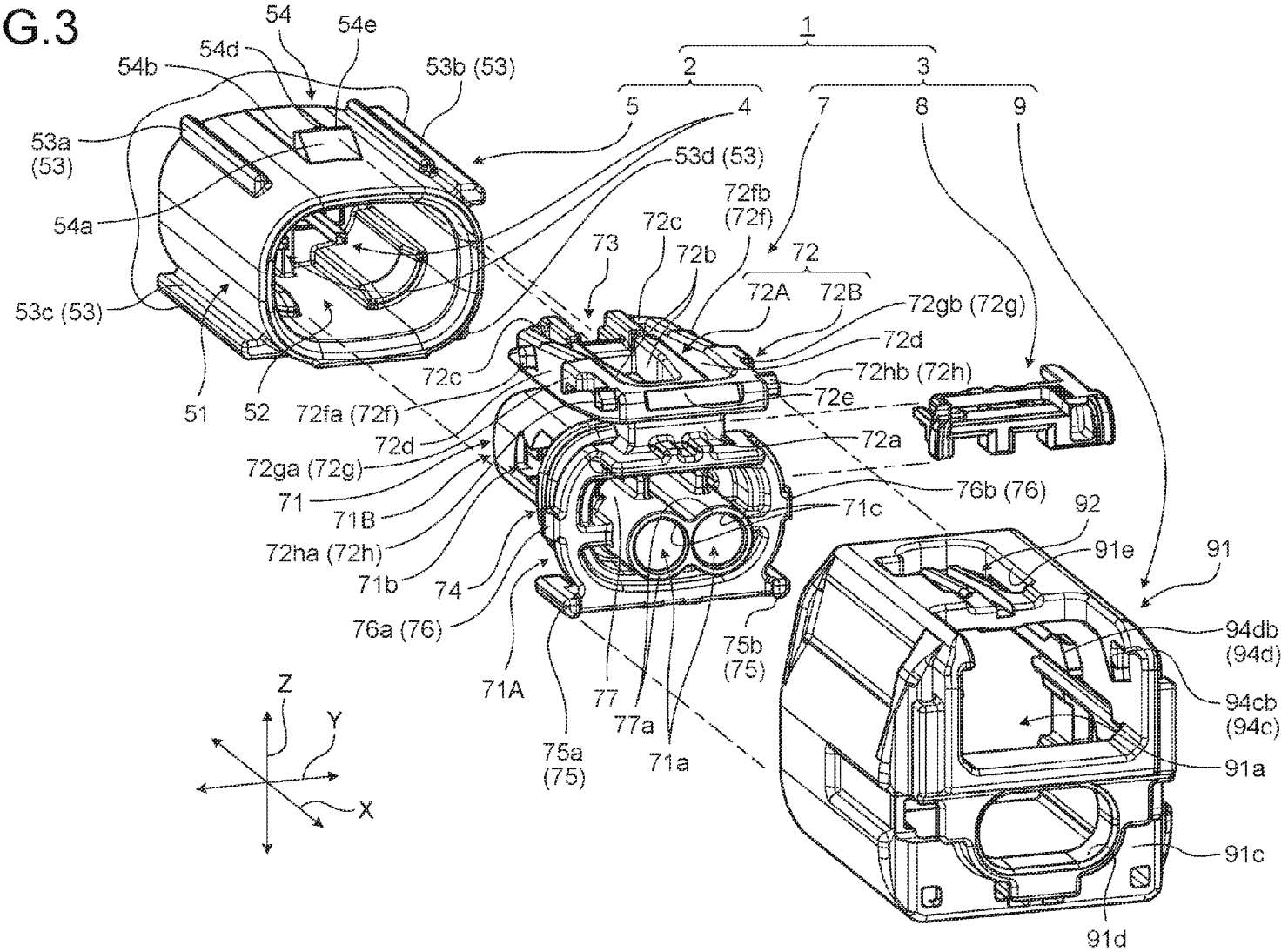
FIG. 3 is an exploded perspective view of the schematic configuration of the connector according to the embodiment.
Figure 4:
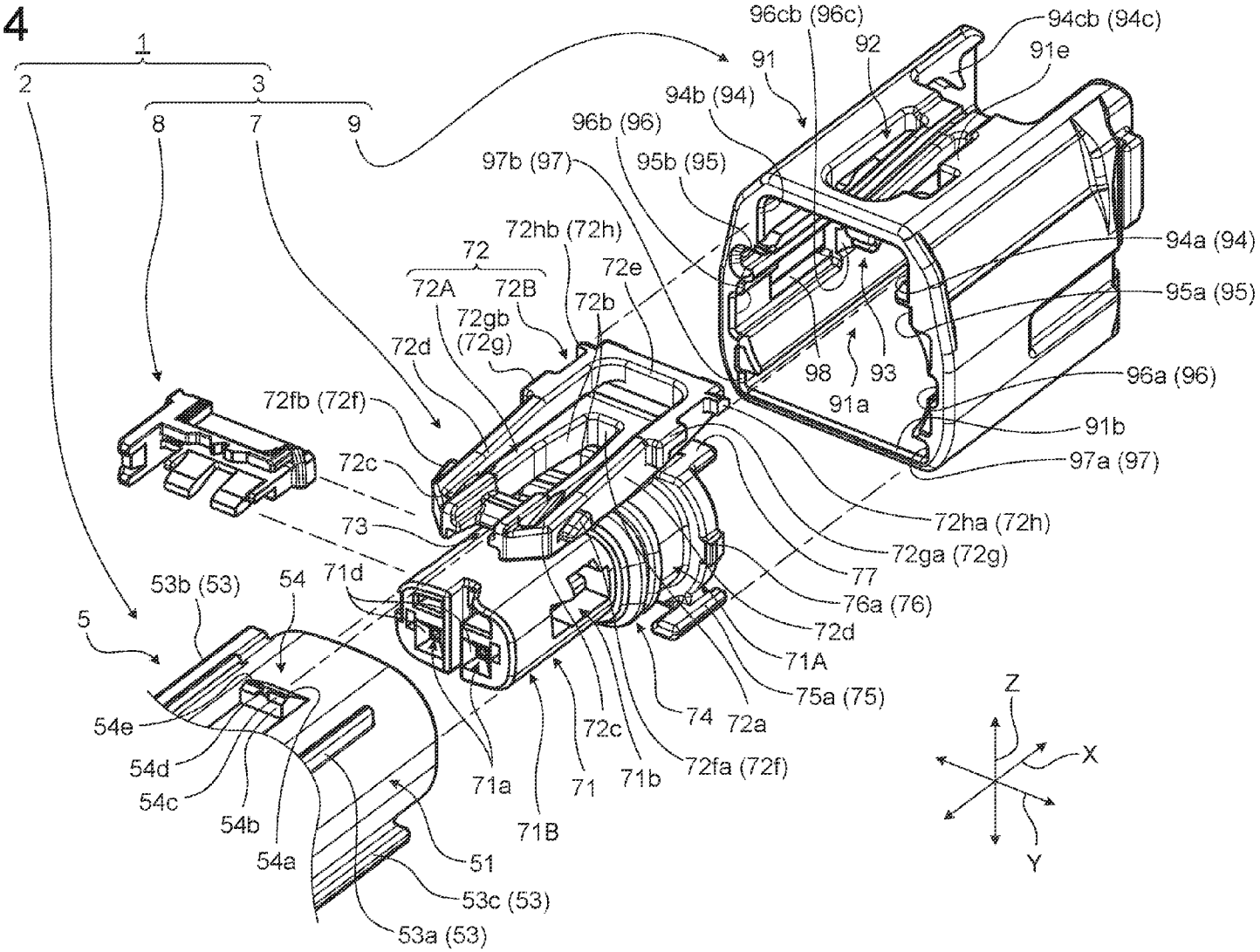
FIG. 4 is an exploded perspective view of the schematic configuration of the connector according to the embodiment.

FIG. 1 and FIG. 2 represent a state in which components included in the female connector are combined, whereas FIG. 3 and FIG. 4 represent a state in which the components included in the female connector are exploded. FIG. 1, FIG. 5, FIG. 21, and FIG. 22 illustrate partial electric wires connected to terminals by chain double-dashed lines, whereas the other drawings omit the illustration of the electric wires. Similarly, FIG. 5, FIG. 20, FIG. 21, and FIG. 22 illustrate female terminals of the female connector by chain double-dashed lines, whereas the other drawings omit the illustration of the female terminals. As to a male housing, the drawings partially illustrate part thereof including a hood. FIG. 7 illustrates a state in which the CPA member is in an initial position. FIG. 9 illustrates a state in which the male housing and the female housing are completely fit into each other. FIG. 10 illustrates a state in which the CPA member is in a fitting assured position.

A connector 1 of the present embodiment illustrated in FIG. 1, FIG. 2, FIG. 3, FIG. 4, and the like is used for a wire harness WH and the like used for automobiles and the like, for example. The connector 1 is a connecting mechanism for electric wire-to-electric wire connection that connects an electric wire W1 and an electric wire W2 included in the wire harness WH. The electric wires W1 and W2 each include a conductor (a core wire) obtained by twisting a plurality of conductive metallic elemental wires together and an insulating sheath covering the outside of the conductor, for example. This connector 1 includes a male connector 2 as a first connector and a female connector 3 as a second connector. The male connector 2 and the female connector 3 are fit into each other to be connector-connected, whereby a male terminal 4 and a female terminal 6 included in the male connector 2 and the female connector 3, respectively, are electrically connected to each other to form an electric connected part therebetween.

In the following description, among a first direction, a second direction, and a third direction crossing each other, the first direction is referred to as an "axial direction X," the second direction is referred to as a "width direction Y," and the third direction is referred to as a "height direction Z." In this example, the axial direction X, the width direction Y, and the height direction Z are orthogonal to each other. The axial direction X is typically a direction along the fitting direction between the male connector 2 and the female connector 3 and is in other words a direction along the extending direction of the male terminal 4 and the female terminal 6 included in the male connector 2 and the female connector 3, respectively. The male connector 2 and the female connector 3 are arranged facing each other to be fit into each other in the axial direction X. The respective directions used in the following description represent directions with parts assembled to each other unless otherwise specified.

As illustrated in FIG. 1, FIG. 2, FIG. 3, FIG. 4, and the like, the male connector 2 is a male-type connector connected to an end of the electric wire W1 as a first electric wire included in the wire harness WH. The male connector 2 includes the male terminal 4 as a first terminal and a male housing 5 as a first housing in which the male terminal 4 is provided. In the following description, in the male connector 2, the female connector 3 side in the axial direction X may be referred to as a front side, whereas the opposite side may be referred to as a rear side in the axial direction X.

The male terminal 4 is a male-type terminal metal fitting for connector use, is connected to the end of the electric wire W1, and is formed of conductive metal as a whole. The male housing 5 is a male-type connector housing in which the male terminal 4 is provided and is formed of an insulating synthetic resin material or the like. The male housing 5 includes a hood 51 formed with a fitting space 52. The hood 51 is formed in a substantially elliptic cylindrical shape the axial line of which is along the axial direction X and forms the fitting space 52 therewithin. The fitting space 52 is a space into which a female housing 7 of the female connector 3 described below is fit. The male housing 5 holds the male terminal 4 so as to expose the tip (the front-side end in the axial direction X) of the male terminal 4 within the fitting space 52. The male terminal 4 extends in the axial direction X while being held by the male housing 5. The end (the rear-side end in the axial direction X) opposite to the tip exposed within the fitting space 52 of the male terminal 4 is held within a terminal insertion room (may also be called a cavity) of a terminal holding part integrally formed with the hood 51, for example, and the electric wire W1 is connected to the end. The male terminal 4 is inserted into the terminal insertion room from the rear side in the axial direction X to be held thereby, and the tip on the front side in the axial direction X is exposed within the fitting space 52 of the hood 51. In the male connector 2, the hood 51 opens toward the front side in the axial direction X, whereas the electric wire W1 extends toward the rear side in the axial direction X. The male housing 5 holds a plurality of, or two in this example, male terminals 4.

The male connector 2 includes a plurality of protruding ribs 53 and a male beak 54 as a first lock part on the outer face of the hood 51. The protruding ribs 53 are formed to protrude from the outer face of the hood 51 and extend in a linear-rod shape in the axial direction X. The protruding ribs 53 are parts that are inserted into a CPA member 9 and are supported by the CPA member 9. A total of four protruding ribs 53, or one for each of four edges of the hood 51, are provided. In this example, when the four protruding ribs 53 are described as distinguished from each other, they may be referred to as protruding ribs 53*a*, 53*b*, 53*c*, and 53*d* for the sake of convenience. The male beak 54 is formed to protrude from the outer face of the hood 51. One male beak 54 is formed in a pawl shape at substantially the center of one of the outer faces along the axial direction X and the width direction Y of the hood 51. The male beak 54 is formed to protrude in the height direction Z. The male beak 54 is a part to which a female lock part 73 of the female connector 3 described below is locked. The shape of this male beak 54 will described below in more detail.

As illustrated in FIG. 1, FIG. 2, FIG. 3, FIG. 4, FIG. 5, and the like, the female connector 3 is a female-type connector connected to an end of the electric wire W2 as a second electric wire included in the wire harness WH. The female connector 3 includes the female terminal 6 (refer to FIG. 5) as a second terminal, the female housing 7 as a second housing in which the female terminal 6 is provided, a spacer 8 assembled to the female housing 7, and the CPA member 9 as a fitting detection member assembled to the female housing 7 in a relatively movable manner in the axial direction X. In the following description, in the female connector 3, the male connector 2 side in the axial direction X may be referred to as a front side, whereas the opposite side may be referred to as a rear side in the axial direction X.

The female terminal 6 is a female-type terminal metal fitting for connector use, is connected to the end of the electric wire W2, and is formed of conductive metal as a whole. In the female connector 3, the female housing 7 is fit into the fitting space 52 of the male housing 5, and the female terminal 6 is electrically connected to the male terminal 4 of the male connector 2.

As illustrated in FIG. 3, FIG. 4, and FIG. 5, the female housing 7 is a female-type connector housing in which the female terminal 6 is provided and is formed of an insulating synthetic resin material or the like. The female housing 7 is a member that holds the female terminal 6 and can be fit into the fitting space 52 of the male housing 5. The female housing 7 includes a female main body 71 that holds the female terminal 6 and to which the spacer 8 and the CPA member 9 are assembled, a female lock arm 72 extending from the female main body 71, and the female lock part 73 as a second lock part formed in the female lock arm 72. The female main body 71 is formed in a substantially elliptic cylindrical shape the axial line of which is along the axial direction X. The female lock arm 72 is supported in a cantilever manner at the rear-side end in the axial direction X of the female main body 71 and extends towards the front side in the axial direction X. The female lock part 73 is formed at the front-side end in the axial direction X in the female lock arm 72. The female lock arm 72 and the female lock part 73 are included in a lock mechanism for locking the female housing 7 to the male housing 5 of the male connector 2. In the female housing 7, the female main body 71, the female lock arm 72, and the female lock part 73 are integrally formed of an insulating synthetic resin material or the like.

The female main body 71 is a part to be fit into the fitting space 52 of the male housing 5 and includes a terminal insertion room 71*a* and a spacer fitting part 71*b*, which are integrally formed. The female main body 71 holds the female terminal 6 by causing the female terminal 6 to be inserted into the terminal insertion room 71*a* from the rear side in the axial direction X and causing the spacer 8 to be inserted into the spacer fitting part 71*b* from one side in the width direction Y.

Specifically, the terminal insertion room 71*a* is a space that enables the female terminal 6 to be inserted thereinto in the axial direction X and holds the female terminal 6. The terminal insertion room 71*a* may be called a cavity. The terminal insertion room 71*a* extends within the female main body 71 to be formed in a hollow shape and houses the female terminal 6. The terminal insertion room 71*a* extends in the axial direction X. The terminal insertion room 71*a* is formed as a space of size and shape into which the female terminal 6 can be inserted in accordance with the outer shape of the female terminal 6. The terminal insertion room 71*a* is formed with a female terminal insertion opening 71*c* on the rear side in the axial direction X and is formed with a male terminal insertion opening 71*d* on the front side in the axial direction X. The female terminal insertion opening 71*c* opens as an opening into which the female terminal 6 is inserted toward the outside of the female main body 71 toward the rear side in the axial direction X. The male terminal insertion opening 71*d* opens as an opening into which the male terminal 4 of the male connector 2 to be electrically connected to the female terminal 6 is inserted toward the outside of the female main body 71 toward the front side in the axial direction X. A plurality of, or two, Y-direction, side-by-side in this example, terminal insertion rooms 71*a* are provided in accordance with the number of a plurality of female terminals 6 provided in the female connector 3. In the female main body 71, the female terminals 6 are inserted into the terminal insertion rooms 71*a* via the female terminal insertion openings 71*c*.

The spacer fitting part 71*b* is a space into which the spacer 8 is fit. The spacer fitting part 71*b* extends in a direction crossing the extending direction of the terminal insertion room 71*a*, or in the width direction Y in this example, and communicates with the terminal insertion room 71*a*. The spacer fitting part 71*b* communicates with the middle parts in the axial direction X of the respective terminal insertion rooms 71*a* and passes through the female main body 71 in the width direction Y.

More specifically, the female main body 71 of the present embodiment includes a large-diameter part 71A extending in the axial direction X and a small-diameter part 71B, which are integrally formed as a whole. Both the large-diameter part 71A and the small-diameter part 71B are formed in a substantially elliptic cylindrical shape the axial line of which is along the axial direction X and are formed integrally adjacent to each other in the axial direction X with the large-diameter part 71A positioned on the rear side in the axial direction X and with the small-diameter part 71B positioned on the front side in the axial direction X. The diameter in a direction orthogonal to the axial direction X of the large-diameter part 71A is formed to be larger than that of the small-diameter part 71B. In other words, the diameter in the direction orthogonal to the axial direction X of the small-diameter part 71B is formed to be smaller than that of the large-diameter part 71A. The large-diameter part 71A is a part serving as a basal end supporting the female lock arm 72 in a cantilever manner. The small-diameter part 71B is a part to be fit into the fitting space 52 of the male housing 5 in the female main body 71 and is formed in size and shape that can be fit into the fitting space 52. The large-diameter part 71A is exposed out of the fitting space 52 of the male housing 5 with the small-diameter part 71B fit into the fitting space 52. In this example, the female main body 71 is equipped with a watertight packing 74 formed in an annular shape at a stepped part between the large-diameter part 71A and the small-diameter part 71B. The terminal insertion room 71*a* extends across the large-diameter part 71A and the small-diameter part 71B in the axial direction X in the female main body 71. The spacer fitting part 71*b* is formed in the small-diameter part 71B in the female main body 71.

The female main body 71 further includes a plurality of protruding ribs 75 and a plurality of regulating protrusions 76 on the outer face of the large-diameter part 71A. The protruding ribs 75 are formed to protrude from the outer face at the rear-side end in the axial direction X of the large-diameter part 71A and extend in a linear-rod shape in the axial direction X. The protruding ribs 75 are parts that will be inserted into the CPA member 9 to be supported by the CPA member 9. A total of two protruding ribs 75, or one for each of two edges of the large-diameter part 71A, are provided. In this example, when the two protruding ribs 75 are described as distinguished from each other, they may be referred to as protruding ribs 75*a* and 75*b* for the sake of convenience. The protruding ribs 75*a* and 75*b* are provided at the two edges on the side opposite to the side on which the female lock arm 72 is provided in the height direction Z. The protruding ribs 75*a* and 75*b* are formed at positions facing each other in the width direction Y. The regulating protrusions 76 are formed to protrude from the outer face at the rear-side end in the axial direction X of the large-diameter part 71A. The regulating protrusions 76 are parts that will be inserted into the CPA member 9 to come into contact with a certain part (a regulating protrusion 96*c* of the CPA member 9 described below), thereby regulating the relative movement in the axial direction X of the female housing 7 and the CPA member 9 to a certain position (the initial position of the CPA member 9 described below). At a middle part in the height direction Z at both ends in the width direction Y of the large-diameter part 71A, a total of two, or one for each of both ends, regulating protrusions 76 are formed in a pawl shape to protrude in the width direction Y. In this example, when the two regulating protrusions 76 are described as distinguished from each other, they may be referred to as regulating protrusions 76*a* and 76*b* for the sake of convenience. The regulating protrusions 76*a* and 76*b* are formed at positions facing each other in the width direction Y.

The female housing 7 of the present embodiment is formed with a regulating end face 77 at the rear-side end face in the axial direction X of the large-diameter part 71A of the female main body 71. The regulating end face 77 is a part that will come into contact with a certain part (a regulating wall 91*c* of the CPA member 9 described below) of the CPA member 9, thereby regulating the relative movement in the axial direction X of the female housing 7 and the CPA member 9 to a certain position (the fitting assured position of the CPA member 9 described below). The regulating end face 77 is formed with a cylindrical part 77*a* protruding in a cylindrical shape in the axial direction X. In the cylindrical part 77*a*, the space on the inner peripheral side thereof is included in the terminal insertion room 71*a*, whereas the rear-side opening in the axial direction X thereof is included in the female terminal insertion opening 71*c*. A plurality of, or two, Y-direction, side-by-side in this example, cylindrical parts 77*a* are provided in accordance with the number of the terminal insertion rooms 71*a* and are coupled with each other to be integrated with each other.

The female lock arm 72 is a part that is supported in a cantilever manner having flexibility relative to the large-diameter part 71A of the female main body 71 and in this example, includes a first arm 72A and a second arm 72B, which are integrally formed as a whole.

The first arm 72A is supported by the rear-side end in the axial direction X of the female main body 71, or the large-diameter part 71A in this example, and is formed to extend in a cantilever manner having flexibility toward the front side in the axial direction X. The first arm 72A includes a basal end 72*a* protruding from the large-diameter part 71A of the female main body 71 and a pair of cantilever-shaped parts 72*b* extending from the basal end 72*a* and is formed in a lever shape as a whole. The basal end 72*a* is formed to protrude in the height direction Z from the large-diameter part 71A of the female main body 71. The pair of cantilever-shaped parts 72*b* extend toward the front side in the axial direction X from the tip in the height direction Z of the basal end 72*a*. The pair of cantilever-shaped parts 72*b* are formed to face each other in the width direction Y and to be in parallel with other in the axial direction X. The pair of cantilever-shaped parts 72*b* support the female lock part 73 at the end opposite to the basal end 72*a*, that is, at the front-side end in the axial direction X. The pair of cantilever-shaped parts 72*b* support the female lock part 73 so as to hold the female lock part 73 therebetween in the width direction Y. In other words, the female lock part 73 is formed in a beam shape in the width direction Y in between the pair of cantilever-shaped parts 72*b* in the width direction Y and couples the cantilever-shaped parts 72*b* with each other. The first arm 72A is supported in an elastically deformable cantilever manner by the basal end 72*a* on the rear side in the axial direction X, which makes the female lock part 73 on the front side in the axial direction X a free end. With this structure, the first arm 72A is supported in an elastically deformable manner in the height direction Z relative to the large-diameter part 71A of the female main body 71.

The second arm 72B is supported by the front-side end in the axial direction X of the first arm 72A, or the front-side end in the axial direction X of the pair of cantilever-shaped parts 72*b* in this example, and is formed to extend in a cantilever manner having flexibility toward the rear side in the axial direction X. The second arm 72B includes a pair of basal ends 72*c* protruding from the pair of respective cantilever-shaped parts 72*b* of the first arm 72A, a pair of cantilever-shaped parts 72*d* protruding from the respective pair of basal ends 72*c*, and a coupling part 72*e* that couples the pair of cantilever-shaped parts 72*d* with each other and is formed in a lever shape as a whole. The pair of basal ends 72*c* are formed to protrude in mutually opposite directions in the width direction Y from the pair of respective cantilever-shaped parts 72*b*, that is, toward the side opposite to the female lock part 73. The pair of cantilever-shaped parts 72*d* extend toward the rear side in the axial direction X from the tips in the width direction Y of the pair of respective basal ends 72*c*. The pair of cantilever-shaped parts 72*d* are formed to face each other in the width direction Y and to be in parallel with each other in the axial direction X. More specifically, the pair of cantilever-shaped parts 72*d* are formed to be in parallel with each other in the axial direction X to hold the pair of cantilever-shaped parts 72*b* therebetween in the width direction Y. The coupling part 72*e* couples the ends on the side opposite to the basal ends 72*c* of the pair of cantilever-shaped parts 72*d*, that is, the rear-side ends in the axial direction X with each other. In other words, the coupling part 72*e* is formed in a beam shape in the width direction Y in between the pair of cantilever-shaped parts 72*d* in the width direction Y and couples the pair of cantilever-shaped parts 72*d* with each other. The second arm 72B is supported in an elastically deformable cantilever manner by the basal ends 72*c* on the front side in the axial direction X, which makes the coupling part 72*e* on the rear side in the axial direction X a free end. With this structure, the second arm 72B is supported in an elastically deformable manner in the height direction Z relative to the first arm 72A. The pair of cantilever-shaped parts 72*d* are provided with a plurality of protruding ribs 72*f*, 72*g*, and 72*h* on the respective outer faces in the width direction Y, that is, on the faces opposite to the faces facing the cantilever-shaped parts 72*b*. The protruding ribs 72*f*, 72*g*, and 72*h* are formed to protrude in the width direction Y from the respective cantilever-shaped parts 72*d*. The protruding ribs 72*f*, 72*g*, and 72*h* are formed spaced apart from each other in the axial direction X on the respective cantilever-shaped parts 72*d*. The protruding ribs 72*f*, 72*g*, and 72*h* are formed in the order of the protruding rib 72*f*, the protruding rib 72*g*, and the protruding rib 72*h* from the front side toward the rear side in the axial direction X. In this example, when the two protruding ribs 72*f* are described as distinguished from each other, they may be referred to as protruding ribs 72*fa* and 72*fb* for the sake of convenience. Similarly, when the two protruding ribs 72*g* are described as distinguished from each other, they may be referred to as protruding ribs 72*ga* and 72*gb* for the sake of convenience, and when the two protruding ribs 72*h* are described as distinguished from each other, they may be referred to as protruding ribs 72*ha* and 72*hb* for the sake of convenience.

The female lock part 73 is a part that can ride over the male beak 54 to be locked to the male beak 54 with the small-diameter part 71B of the female main body 71 of the female housing 7 fit into the fitting space 52 of the male housing 5 (hereinafter, may be referred to simply as "with the male housing 5 fit into the female housing 7"). As described above, the female lock part 73 is supported in between the front-side ends in the axial direction X of the pair of cantilever-shaped parts 72*b*. The female lock part 73 is formed in a beam shape in the width direction Y and couples the pair of cantilever-shaped parts 72*b* with each other. The shape of this female lock part 73 will be described below in more detail.

Next, as illustrated in FIG. 3, FIG. 4, FIG. 5, and the like, the spacer 8 to be assembled to the female housing 7 is a member that ensures appropriate terminal holding force to hold the female terminal 6 in the terminal insertion room 71*a*. The spacer 8 is formed in size and shape that can be fit into the spacer fitting part 71*b* and will be assembled to the spacer fitting part 71*b* in a detachable manner in the width direction Y. The spacer 8 is assembled to a certain position so as to be inserted into the spacer fitting part 71*b*, thereby locking the respective female terminals 6 inserted into and held by the respective terminal insertion rooms 71*a* to standard positions within the respective terminal insertion rooms 71*a*. The standard position of the female terminal 6 within the terminal insertion room 71*a* is a position that ensures appropriate electric connection between the female terminal 6 and the male terminal 4.

Next, as illustrated in FIG. 3, FIG. 4, FIG. 6, and the like, the CPA member 9 to be assembled to the female housing 7 is a member that will be assembled so as to cover the outside of the female housing 7 to detect that the male connector 2 and the female housing 7 have been completely fit into each other and is a functional member for achieving what is called connector position assurance (CPA: fitting assurance function). The CPA member 9 is assembled to the female housing 7 in a relatively movable manner in the axial direction X. In this example, the state in which the male connector 2 and the female housing 7 have been completely fit into each other is a state in which the female housing 7 has been fit into the fitting space 52 of the male housing 5 at an appropriate fitting position and is typically a fit state in which the female lock part 73 is locked to the male beak 54 to ensure appropriate electric connection between the female terminal 6 and the male terminal 4.

Specifically, the CPA member 9 includes a CPA main body 91 to be assembled to the female housing 7, a CPA lock arm 92 extending from the CPA main body 91, and a CPA lock part 93 as a third lock part formed on the CPA lock arm 92. The CPA main body 91 is formed in a substantially quadrangular prismatic shape the axial line of which is along the axial direction X. The CPA lock arm 92 is supported in a cantilever manner at the rear-side end in the axial direction X of the CPA main body 91 and extends toward the front side in the axial direction X. The CPA lock part 93 is formed at the front-side end in the axial direction X on the CPA lock arm 92. The CPA lock arm 92 and the CPA lock part 93 are included in a lock mechanism for locking the CPA member 9 to the female housing 7. In the CPA member 9, the CPA main body 91, the CPA lock arm 92, and the CPA lock part 93 are integrally formed of an insulating synthetic resin material or the like.

The CPA main body 91 is a part mounted on the female housing 7 so as to cover the outside of the female housing 7 and is in other words a part into which the female housing 7 is inserted to be held thereby. The CPA main body 91 is formed in a substantially quadrangular prismatic shape as described above and is formed with a holding room 91*a* therewithin. The holding room 91*a* is a space into which the female housing 7 can be inserted in the axial direction X and that holds the female housing 7 in a relatively movable manner. The holding room 91*a* extends within the CPA main body 91 to be formed in a hollow shape and houses the female housing 7. The holding room 91*a* extends in the axial direction X. The holding room 91*a* is formed as a space of size and shape into which the female housing 7 can be inserted in accordance with the outer shape of the female housing 7. The holding room 91*a* is formed with a housing insertion opening 91*b* on the front side in the axial direction X and is provided with a regulating wall 91*c* on the rear side in the axial direction X. The housing insertion opening 91*b* opens toward the outside of the CPA main body 91 toward the front side in the axial direction X as an opening into which the female housing 7 is inserted. In the CPA main body 91, the female housing 7 is inserted into the holding room 91*a* via the housing insertion opening 91*b*. The regulating wall 91*c* is a part that comes into contact with the regulating end face 77 of the female housing 7, thereby regulating the relative movement in the axial direction X of the female housing 7 and the CPA member 9 to the certain position (the fitting assured position of the CPA member 9 described below). The regulating wall 91*c* is formed to block part of the opening on the rear side in the axial direction X of the CPA main body 91 and is formed with a through hole 91*d* into which the cylindrical part 77*a* can be inserted in the axial direction X.

Further, the CPA main body 91 includes a pair of first guide recesses 94, a pair of second guide recesses 95, a pair of third guide recesses 96, and a pair of fourth guide recesses 97 on the inner face on the holding room 91*a* side, that is, on the inner face facing the holding room 91*a* and defining the holding room 91*a*. The first guide recesses 94, the second guide recesses 95, the third guide recesses 96, and the fourth guide recesses 97 are parts each into which part of the female housing 7 or part of the male housing 5 is inserted and that can guide it in the axial direction X. The first guide recesses 94, the second guide recesses 95, the third guide recesses 96, and the fourth guide recesses 97 are provided on the inner face in the height direction Z of the CPA main body 91 in the order of the first guide recesses 94, the second guide recesses 95, the third guide recesses 96, and the fourth guide recesses 97 from one side toward the other side in the height direction Z. Each of the first guide recesses 94, each of the second guide recesses 95, each of the third guide recesses 96, and each of the fourth guide recesses 97 are formed in a recessed shape recessed in the width direction Y and extend in the axial direction X. The pair of first guide recesses 94 are formed at positions facing each other in the width direction Y. The protruding ribs 72*f*, 72*g*, and 72*h* of the female lock arm 72 of the female housing 7 are inserted into the pair of first guide recesses 94 and are supported thereby in a guidable manner in the axial direction X. In this example, when the two first guide recesses 94 are described as distinguished from each other, the one into which the protruding ribs 72*fa*, 72*ga*, and 72*ha* are inserted may be referred to as a first guide recess 94*a*, whereas the one into which the protruding ribs 72*fb*, 72*gb*, and 72*hb* are inserted may be referred to as a first guide recess 94*b* for the sake of convenience. The pair of second guide recesses 95 are formed at positions facing each other in the width direction Y. The protruding ribs 53 of the male housing 5 are inserted into the pair of second guide recesses 95 and are supported thereby in a guidable manner in the axial direction X. In this example, when the two second guide recesses 95 are described as distinguished from each other, the one into which the protruding rib 53*a* is inserted may be referred to as a second guide recess 95*a*, whereas the one into which the protruding rib 53*b* is inserted may be referred to as a second guide recess 95*b* for the sake of convenience. The pair of third guide recesses 96 are formed at positions facing each other in the width direction Y. The regulating protrusions 76 of the female main body 71 of the female housing 7 are inserted into the pair of third guide recesses 96 and are supported thereby in a guidable manner in the axial direction X. In this example, when the two third guide recesses 96 are described as distinguished from each other, the one into which the regulating protrusion 76*a* is inserted may be referred to as a third guide recess 96*a*, whereas the one into which the regulating protrusion 76*b* is inserted may be referred to as a third guide recess 96*b* for the sake of convenience. The CPA main body 91 is formed with a spacer insertion opening 98 for inserting the spacer 8 into the spacer fitting part 71*b* of the female main body 71 at the middle part in the axial direction X of the third guide recess 96*b*. The pair of fourth guide recesses 97 are formed at positions facing each other in the width direction Y. The protruding ribs 75 of the female main body 71 of the female housing 7 and the protruding ribs 53 of the male housing 5 are inserted into the pair of fourth guide recesses 97 and are supported thereby in a guidable manner in the axial direction X. In this example, when the two fourth guide recesses 97 are described as distinguished from each other, the one into which the protruding ribs 75*a* and 53*c* are inserted may be referred to as a fourth guide recess 97*a*, whereas the one into which the protruding ribs 75*b* and 53*d* are inserted may be referred to as a fourth guide recess 97*b*.

In the CPA main body 91, lock protrusions 94*c* and regulating protrusions 94*d* protrude from the respective first guide recesses 94. The lock protrusions 94*c* are formed at the rear side-ends in the axial direction X within the respective first guide recesses 94. The lock protrusions 94*c* are parts locked between the protruding ribs 72*g* and the protruding ribs 72*h* of the female lock arm 72 with the CPA member 9 at the certain position (the fitting assured position of the CPA member 9 described below). In this example, when the two lock protrusions 94*c* are described as distinguished from each other, the one provided in the first guide recess 94*a* may be referred to as a lock protrusion 94*ca*, whereas the one provided in the first guide recess 94*b* may be referred to as a lock protrusion 94*cb* for the sake of convenience. The regulating protrusions 94*d* are formed at middle parts in the axial direction X within the respective first guide recesses 94. The regulating protrusions 94*d* are parts that come into contact with the protruding ribs 72*f* of the female lock arm 72 of the female housing 7, thereby regulating the relative movement in the axial direction X of the female housing 7 and the CPA member 9 to the certain position (the fitting assured position of the CPA member 9 described below). In this example, when the two regulating protrusions 94*d* are described as distinguished from each other, the one provided in the first guide recess 94*a* may be referred to as a regulating protrusion 94*da*, whereas the one provided in the first guide recess 94*b* may be referred to as a regulating protrusion 94*db* for the sake of convenience. In the CPA main body 91, regulating protrusions 96*c* protrude within the respective third guide recesses 96. The regulating protrusions 96*c* are formed at middle parts in the axial direction X within the respective third guide recesses 96. The regulating protrusions 96*c* are parts that come into contact with the regulating protrusions 76 of the female main body 71 of the female housing 7, thereby regulating the relative movement in the axial direction X of the female housing 7 and the CPA member 9 to the certain position (the initial position of the CPA member 9 described below). In this example, when the two regulating protrusions 96*c* are described as distinguished from each other, the one provided in the third guide recess 96*a* may be referred to as a regulating protrusion 96*ca*, whereas the one provided in the third guide recess 96*b* may be referred to as a regulating protrusion 96*cb* for the sake of convenience.

The CPA lock arm 92 is a substantially quadrangular prism-shaped part formed to protrude toward an opening 91*e* formed on a face on one side in the height direction Z of the CPA main body 91, or on the face on the side at which the first guide recesses 94 are positioned in this example. The CPA lock arm 92 is supported by the rear side-edge in the axial direction X of the opening 91*e* and is formed to extend in a cantilever manner having flexibility toward the front side in the axial direction X. The CPA lock arm 92 extends toward the holding room 91*a*. The CPA lock arm 92 is positioned at substantially the central part of the CPA main body 91 in the width direction Y. The CPA lock arm 92 is supported in an elastically deformable cantilever manner by the rear side basal end in the axial direction X, which makes the front side tip in the axial direction X a free end. With this structure, the CPA lock arm 92 is supported in an elastically deformable manner in the height direction Z relative to the basal end. The CPA lock arm 92 is formed with a CPA lock part 93 at the tip on the front side in the axial direction X.

The CPA lock part 93 is a part that can be locked to the female lock part 73 with the CPA member 9 assembled to the female housing 7 and at the certain position (the fitting assured position of the CPA member 9 described below). The CPA lock part 93 is formed to protrude from the front side tip in the axial direction X of the CPA lock arm 92 toward the holding room 91*a* in the height direction Z. The CPA lock part 93 is positioned in between the pair of cantilever-shaped parts 72*b* with the CPA member 9 assembled to the female housing 7 (refer to FIG. 4 and the like).

In the connector 1 configured as described above, as illustrated in FIG. 1, FIG. 2, FIG. 3, FIG. 4, FIG. 5, and the like, in the female connector 3, the female housing 7 is inserted into the holding room 91*a* via the housing insertion opening 91*b* from the front side in the axial direction X of the CPA member 9. In this case, in the female connector 3, the large-diameter part 71A side of the female housing 7 is inserted into the holding room 91*a*. More specifically, in the female connector 3, the protruding ribs 72*fa*, 72*ga*, and 72*ha* are inserted into the first guide recess 94*a*, the protruding ribs 72*fb*, 72*gb*, and 72*hb* are inserted into the first guide recess 94*b*, the regulating protrusion 76*a* is inserted into the third guide recess 96*a*, the regulating protrusion 76*b* is inserted into the third guide recess 96*b*, the protruding rib 75*a* is inserted into the fourth guide recess 97*a*, the protruding rib 75*b* is inserted into the fourth guide recess 97*b*, and with this positional relation, the relative movement in the axial direction X of the female housing 7 and the CPA member 9 is guided. In the female connector 3, the regulating protrusion 76*a* and the regulating protrusion 76*b* of the female housing 7 ride over the regulating protrusion 96*ca* and the regulating protrusion 96*cb*, respectively, while bending the respective walls of the CPA main body 91 of the CPA member 9, to be inserted into positions on the rear side in the axial direction X of the regulating protrusion 96*ca* and the regulating protrusion 96*cb*, whereby the assembly of the CPA member 9 and the female housing 7 is completed. In the female connector 3 in this state, with positional relation in which the axial line direction of the female main body 71 and the axial line direction of the CPA main body 91 are aligned, the female housing 7 is held within the holding room 91*a* of the CPA main body 91, and the CPA lock part 93 is poisoned in between the pair of cantilever-shaped parts 72*b* in the width direction Y.

In the female connector 3, the female terminals 6 are inserted into the respective terminal insertion rooms 71*a* formed in the female housing 7 from the rear side in the axial direction X via the female terminal insertion openings 71*c*, and the spacer 8 is inserted into the spacer fitting part 71*b* from one side in the width direction Y via the spacer insertion opening 98 and the like, whereby the female terminals 6 are locked to the standard positions within the respective terminal insertion rooms 71*a* and are held.

In the female connector 3 of the present embodiment, with the CPA member 9 assembled to the female housing 7 as described above, as illustrated in FIG. 7, FIG. 9, FIG. 10, and the like, the CPA member 9 can relatively move between the initial position and the fitting assured position in the axial direction X while being guided by the first guide recesses 94, the second guide recesses 95, the third guide recesses 96, and the fourth guide recesses 97.

As illustrated in FIG. 7 and the like, the initial position of the CPA member 9 is a position positioned before the male housing 5 of the male connector 2 and the female housing 7 of the female connector 3 are completely fit into each other and is typically a position in which the CPA lock part 93 is on the rear side in the axial direction X of the female lock part 73. The CPA member 9 is basically positioned at this initial position before the male housing 5 and the female housing 7 are completely fit into each other. The CPA member 9 at the initial position is prevented from relatively moving toward the front side in the axial direction X relative to the female housing 7, that is, toward the fitting assured position described below owing to the fact that the front side-end in the axial direction X of the CPA lock part 93 comes into contact with the rear side-end in the axial direction X of the female lock part 73. In other words, the CPA member 9 is prevented from relatively moving from the initial position toward the fitting assured position owing to the fact that the CPA lock part 93 comes into contact with the female lock part 73 when the male beak 54 is not interposed between the female lock part 73 and the CPA lock part 93 in the axial direction X, that is, when the female lock part 73 has not yet ridden over the male beak 54 and has not yet been locked to the male beak 54. As illustrated in FIG. 8 and the like, the CPA member 9 at the initial position is prevented from relatively moving toward the rear side in the axial direction X relative to the female housing 7 owing to the fact that the regulating protrusion 96*ca* of the CPA main body 91 comes into contact with the regulating protrusion 76*a* of the female housing 7 and the fact that the regulating protrusion 96*cb* comes into contact with the regulating protrusion 76*b*, whereby the female housing 7 is prevented from falling from the holding room 91*a*.

In the connector 1, with the CPA member 9 assembled to the female housing 7 and with the CPA member 9 at the initial position, the female connector 3 and the male connector 2 are fit into each other. In this case, in the connector 1, the small-diameter part 71B of the female housing 7 is inserted into and fit into the fitting space 52 of the male housing 5, the protruding rib 53*a* is inserted into the second guide recess 95*a* of the CPA member 9, the protruding rib

53*b* is inserted into the second guide recess 95*b*, and with this positional relation, the relative movement in the axial direction X of the female housing 7 and the CPA member 9 and the male housing 5 is guided. In the connector 1, when the female housing 7 and the CPA member 9 are pressed toward the male housing 5 to cause the female housing 7 and the CPA member 9 and the male housing 5 to be close to each other through the relative movement in the axial direction X, along with the relative movement, while the female lock arm 72 (the first arm 72A and the second arm 72B) and the CPA lock arm 92 bend, the female lock part 73 and the CPA lock part 93 ride on the male beak 54. In the connector 1, then, as illustrated in FIG. 9, along with further relative movement of the female housing 7 and the CPA member 9 and the male housing 5, the female lock part 73 rides over the male beak 54 to be locked to the male beak 54, whereby the male housing 5 and the female housing 7 are completely fit into each other. In this state, the connector 1 ensures appropriate electric connection between the female terminal 6 and the male terminal 4. In this state, that is, when the female lock part 73 has ridden over the male beak 54 to be locked to the male beak 54 and the male beak 54 is interposed between the female lock part 73 and the CPA lock part 93 in the axial direction X, the CPA member 9 rides on the make beak 54 to be able to move from the initial position to the fitting assured position. In the connector 1, with the male housing 5 and the female housing 7 completely fit into each other, the CPA member 9 is pressed from the initial position toward the front side in the axial direction X and is thereby moved to the fitting assured position.

As illustrated in FIG. 10 and the like, the fitting assured position of the CPA member 9 is a position to which the female housing 7 of the female connector 3 can move after being completely fit into the male housing 5 of the male connector 2 and is a position at which the CPA member 9 has been pressed toward the front side in the axial direction X from the initial position. In further other words, the fitting assured position of the CPA member 9 is a position that detects and assures that the male housing 5 and the female housing 7 have been completely fit into each other and is typically a position at which the CPA lock part 93 has ridden over the male beak 54 and the female lock part 73 locked to the male beak 54 in succession to be locked to the female lock part 73. The CPA member 9 is basically moved to this fitting assured position after the male housing 5 and the female housing 7 have been completely fit into each other. The CPA member 9 at the fitting assured position is prevented from relatively moving toward the rear side in the axial direction X relative to the female housing 7, that is, toward the initial position owing to the fact that the rear side-end in the axial direction X of the CPA lock part 93 comes into contact with the front side-end in the axial direction X of the female lock part 73. The CPA member 9 at the fitting assured position is prevented from further relatively moving toward the front side in the axial direction X relative to the female housing 7 owing to the fact that the regulating protrusion 94*da* of the CPA member 9 comes into contact with the protruding rib 72*fa* of the female housing 7 and the fact that the regulating protrusion 94*db* comes in contact with the protruding rib 72*fb* or the fact that the regulating wall 91*c* of the CPA member 9 comes into contact with the regulating end face 77 of the female housing 7. In this process, in the connector 1, the cylindrical part 77*a* of the regulating end face 77 is exposed to the rear side in the axial direction X so as to protrude from the through hole 91*d* of the regulating wall 91*c*. Further, as illustrated in FIG. 11 and the like, the CPA member 9 at the fitting assured position is surely maintained to be at the fitting assured position owing to the fact that the lock protrusion 94*ca* of the CPA main body 91 is locked between the protruding rib 72*ga* and the protruding rib 72*ha* of the female housing 7 and the fact that the lock protrusion 94*cb* is locked between the protruding rib 72*gb* and the protruding rib 72*hb*. In the CPA member 9, the initial position and an intermediate position between the initial position and the fitting assured position correspond to a fitting unassured position, in which the complete fitting between the male housing 5 and the female housing 7 have not yet been assured.

As described above, the CPA member 9 can be moved from the initial position to the fitting assured position with the female lock part 73 locked to the male beak 54, and along with the movement from the initial position to the fitting assured position, the CPA lock part 93 rides over the male beak 54 and the female lock part 73 locked to the male beak 54 in succession to be locked to the female lock part 73 at the fitting assured position.

The connector 1 cannot move the male housing 5 from the initial position to the fitting assured position, and the CPA lock part 93 is not locked to the female lock part 73 unless the female housing 7 is completely fit into the male housing 5. Consequently, in other words, the connector 1 can assure that the male housing 5 and the female housing 7 have been completely fit into each other by the fact that the CPA member 9 has been moved from the initial position to the fitting assured position.

In the connector 1 of the present embodiment in the above configuration, as illustrated in FIG. 12, FIG. 13, and the like, the male beak 54 is provided with a drawing slope surface 54*c* and a protrusion 54*d*, whereas the female lock part 73 is provided with a notch 73*c*, thereby reducing the degradation of operation feeling.

As illustrated in FIG. 7, FIG. 9, FIG. 10, FIG. 12, and the like, the male beak 54 includes an override slope 54*a*, a male-side lock face 54*b* as a first lock face, the drawing slope surface 54*c*, and the protrusion 54*d*.

The override slope 54*a* is a slope that the female lock part 73 and the CPA lock part 93 ride on in the male beak 54. The override slope 54*a* is provided at the end on the front side (that is, on the female connector 3 side) in the axial direction X of the male beak 54 in the male housing 5. The override slope 54*a* inclines in the axial direction X and more specifically, inclines from the front side toward the rear side in the axial direction X of the male housing 5 so as to gradually increase a protruding amount from the outer face of the male housing 5. In further other words, the override slope 54*a* is formed to incline such that the inclination angle on the front side in the axial direction X will be an acute angle.

The male-side lock face 54*b* is a face locking the female lock part 73 in the male beak 54. The male-side lock face 54*b* is provided at the end on the rear side (that is, the side opposite to the female connector 3) in the axial direction X of the male beak 54 in the male housing 5. The male side-lock face 54*b* is formed to erect substantially upright from the outer face of the male housing 5.

The drawing slope surface 54*c* is a slope inclining from a protruding tip 54*e* toward the male-side lock face 54*b* in the male beak 54. In other words, the drawing slope surface 54*c* is a slope inclining from the protruding tip 54*e* as the peak of the override slope 54*a* in the male beak 54 toward the lock position of the female lock part 73 by the male-side lock face 54*b*. In further other words, the drawing slope surface 54*c* is a slope directed toward the side opposite to the override slope 54*a*, and the protruding tip 54*e* forms a ridgeline between the override slope 54*a* and the drawing slope surface 54*c*. The drawing slope surface 54*c* guides the female lock part 73 that has overridden the override slope 54*a* toward the lock position by the male beak 54, that is, toward the male-side lock face 54*b*.

The protrusion 54*d* is a part formed to protrude from the drawing slope surface 54*c* in the male beak 54. More specifically, the protrusion 54*d* is formed at a position on the rear side in the axial direction X of the protruding tip 54*e*. In other words, the protrusion 54*d* is positioned nearer to the male side lock face 54*b* than the protruding tip 54*e* and in further other words is positioned on the lock position side of the female lock part 73 by the male-side lock face 54*b*. One protrusion 54*d* is formed at substantially the center in the width direction Y in the male beak 54. In this example, the tip face in the height direction Z of the protrusion 54*d* forms a flat face along the axial direction X together with the protruding tip 54*e*.

As illustrated in FIG. 7, FIG. 9, FIG. 10, FIG. 13, and the like, the female lock part 73 includes a female-side lock face 73*a* as a second lock face, a guide part 73*b*, and the notch 73*c*.

The female side lock face 73*a* is a face to be locked to the male-side lock face 54*b* of the male beak 54 in the female lock part 73. The female-side lock face 73*a* is provided at the end on the rear side (that is, on the side opposite to the male connector 2) in the axial direction X of the female lock part 73 in the female housing 7. The female-side lock face 73*a* faces the male-side lock face 54*b* in the axial direction X to be locked to the male-side lock face 54*b* with the female lock part 73 at the lock position by the male beak 54.

The guide part 73*b* is a part facing the male beak 54 when the female lock part 73 has overridden the male beak 54 in the female lock part 73. The guide part 73*b* is typically a face facing the female main body 71 in the height direction Z in the female lock part 73 and is a face facing the override slope 54*a* and the drawing slope surface 54*c* when the female lock part 73 rides over the male beak 54. In further other words, the guide part 73*b* is a face guided toward the lock position by the male beak 54 while coming in contact with and sliding on the override slope 54*a* and the drawing slope surface 54*c* when the female lock part 73 rides over the male beak 54.

The notch 73*c* is a part that is formed in a recessed shape in the guide part 73*b* and is formed to enable the protrusion 54*d* to be housed in the female lock part 73. The notch 73*c* is positioned at a position substantially equal to the position at which the protrusion 54*d* is formed in the male beak 54 in the width direction Y. The notch 73*c* is formed along the direction of the relative movement of the male beak 54 and the female lock part 73 when the female lock part 73 rides over the male beak 54, that is, in the axial direction X. The notch 73*c* is formed to extend up to the female-side lock face 73*a* and opens on the female-side lock face 73*a*. The notch 73*c* is a part that avoids contact between the female lock part 73 and the protrusion 54*d* along with the relative movement of the female lock part 73 and the male beak 54 by causing the protrusion 54*d* to be housed therein when the female lock part 73 is guided toward the lock position by the male beak 54 by the drawing slope surface 54*c*.

Figure 14:
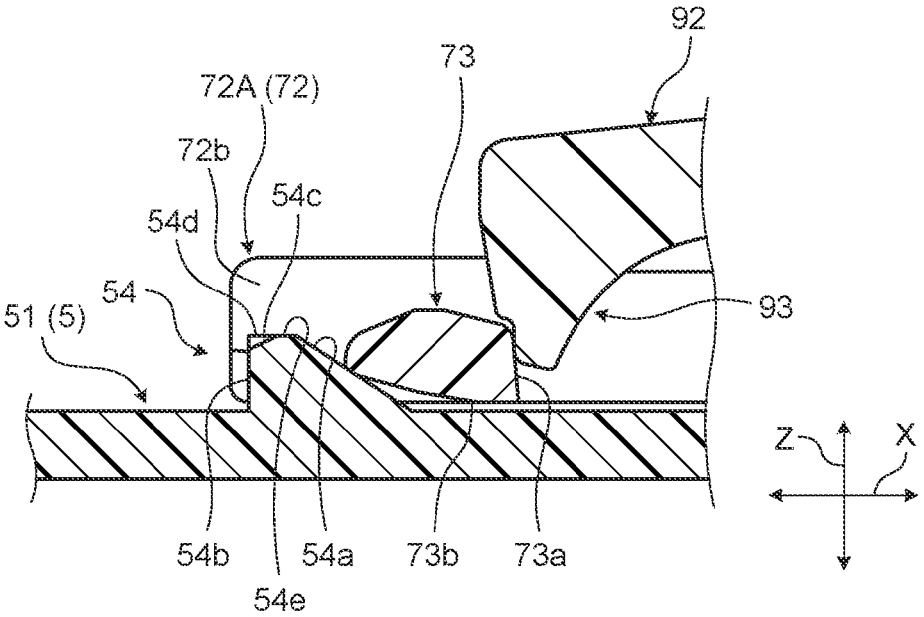
FIG. 14 is a partial sectional view including the male beak, the female lock part, and a CPA lock part included in the connector according to the embodiment.
Figure 15:
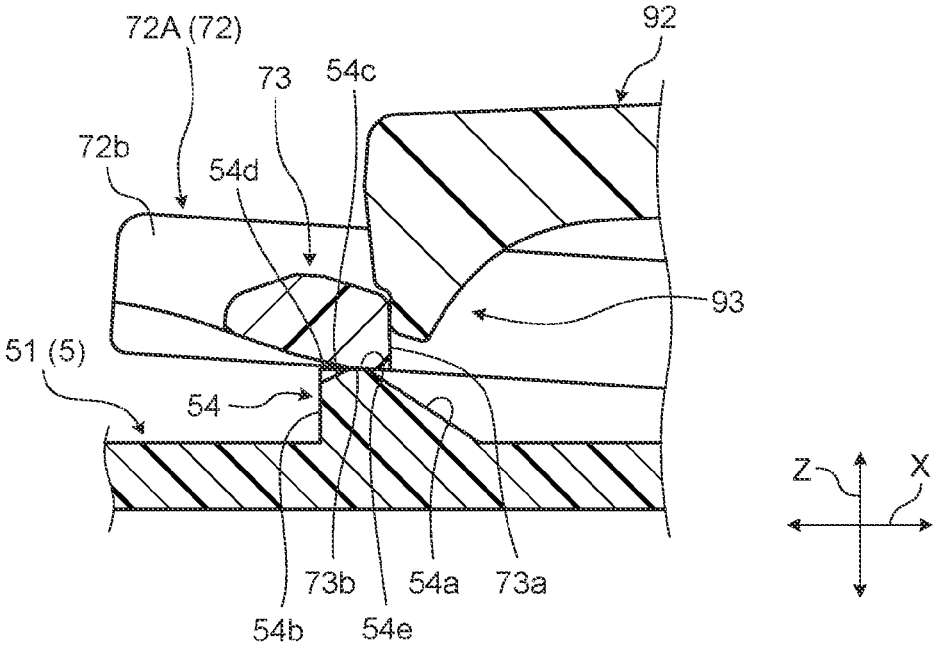
FIG. 15 is a partial sectional view including the male beak, the female lock part, and the CPA lock part included in the connector according to the embodiment.

In the connector 1 configured as described above, when the female housing 7 and the CPA member 9 are pressed toward the male housing 5 from the state in which the CPA member 9 is in the initial position as illustrated in FIG. 7 and the like, the female lock part 73 and the CPA lock part 93 ride on the override slope 54*a* of the male beak 54 along with the relative movement of the female housing 7 and the CPA member 9 and the male housing 5 as illustrated in FIG. 14. In the connector 1, when the female housing 7 and the CPA member 9 are further pressed toward the male housing 5 to relatively move, the guide part 73*b* of the female lock part 73 is guided toward the protruding tip 54*e* of the male beak 54 while coming in contact with and sliding on the override slope 54*a* to further ride on it as illustrated in FIG. 15.

Figure 16:
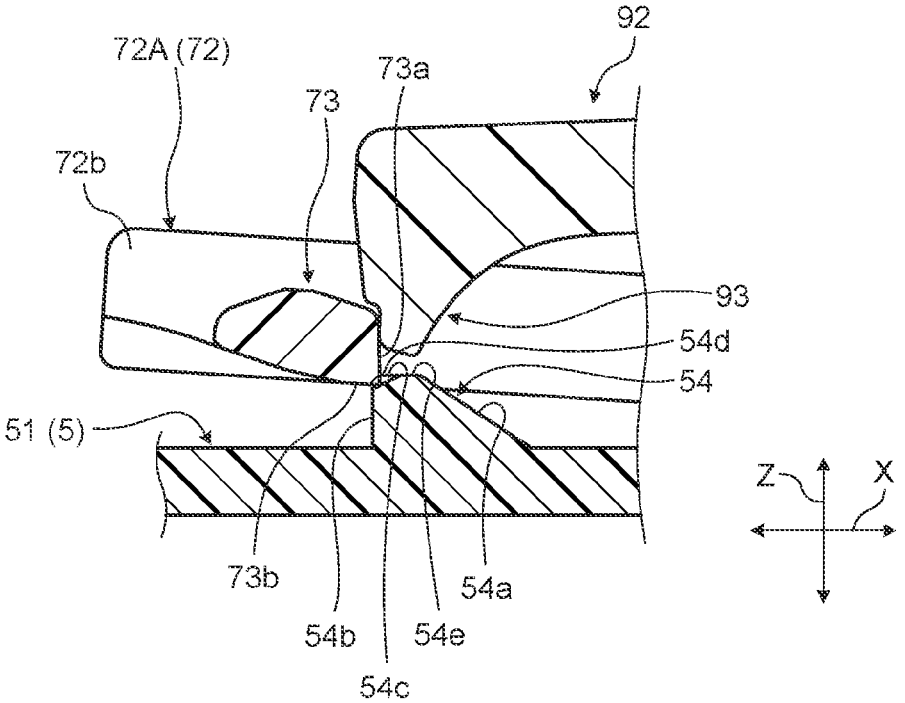
FIG. 16 is a partial sectional view including the male beak, the female lock part, and the CPA lock part included in the connector according to the embodiment.

In the connector 1, when the female housing 7 and the CPA member 9 are further pressed toward the male housing 5 to relatively move from this state, as illustrated in FIG. 16, the guide part 73*b* of the female lock part 73 is guided toward the male-side lock face 54*b* of the male beak 54, that is, toward the lock position of the female lock part 73 by the male beak 54 while coming into contact with and sliding on the drawing slope surface 54*c* and is pulled down. In this process, in the connector 1, as illustrated in FIG. 17, the protrusion 54*d* on the drawing slope surface 54*c* is housed in the notch 73*c* in the female lock part 73 guided toward the lock position by the drawing slope surface 54*c*, whereby contact between the female lock part 73 and the protrusion 54*d* is avoided. Consequently, in the connector 1, as illustrated in FIG. 9 and the like, the female lock part 73 completely rides over the male beak 54 to smoothly move to the lock position by the male beak 54, and the female side lock face 73*a* of the female lock part 73 faces and comes into contact with the male-side lock face 54*b* of the male beak 54 to be locked thereto, thereby achieving a state in which the male housing 5 and the female housing 7 have been completely fit into each other.

In this state, in the connector 1, as illustrated in FIG. 18, the protrusion 54*d* is positioned in between the protruding tip 54*e* of the male beak 54 and the female-side lock face 73*a* of the female lock part 73 in the axial direction X. In other words, the protrusion 54*d* protrudes within a space SP formed between the protruding tip 54*e* of the male beak 54, the drawing slope surface 54*c*, and the female-side lock face 73*a* of the female lock part 73 with the female lock part 73 locked to the male beak 54. The space SP is a gap surrounded by the protruding tip 54*e*, the drawing slope surface 54*c*, and the female-side lock face 73*a* and is in other words a gap formed by the fact that the drawing slope surface 54*c* has been provided. The protrusion 54*d* protrudes towards the space SP formed as the gap.

Figure 19:
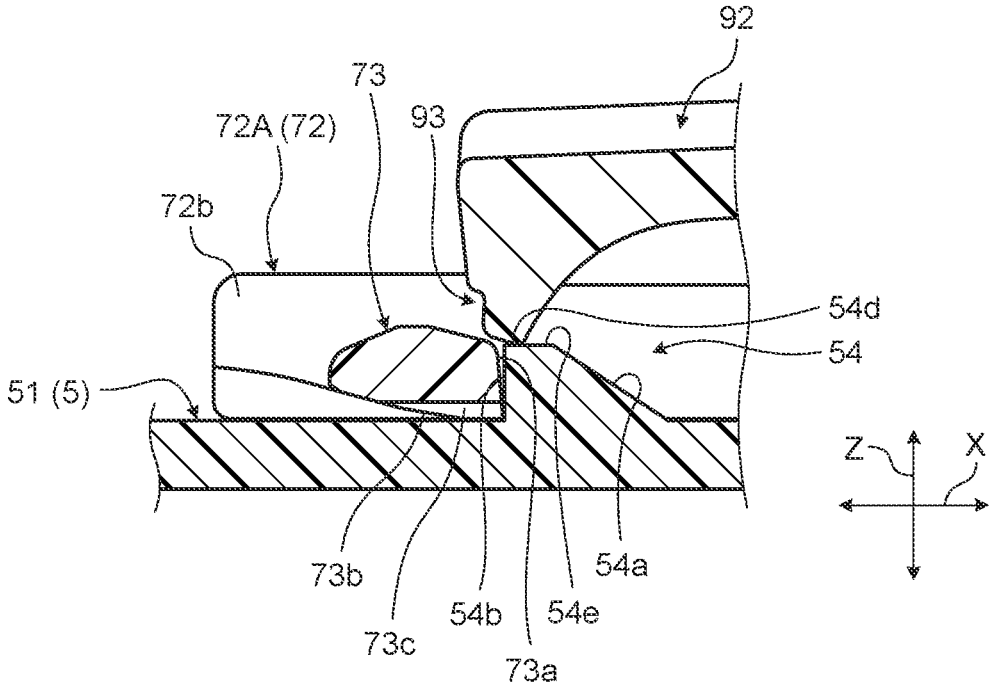
FIG. 19 is a partial sectional view including the male beak, the female lock part, and the CPA lock part included in the connector according to the embodiment.

In the connector 1, when the CPA member 9 is further pressed toward the male housing 5 to relatively move, as illustrated in FIG. 19, the CPA lock part 93, while being supported by the protrusion 54*d* protruding from the drawing slope surface 54*c* between the male beak 54 and the female lock part 73, rides over the male beak 54 and the female lock part 73 in succession. In other words, in the connector 1, when crossing the part of the space SP formed in between the male beak 54 and the female lock part 73, the CPA lock part 93 crosses the part of the space SP while being supported by the protrusion 54*d*, and the CPA lock part 93 is prevented from being caught between the male beak 54 and the female lock part 73. In the connector 1, as illustrated in FIG. 10 and the like, the CPA lock part 93 moves to the fitting assured position, in which the CPA member 9 is locked to the female lock part 73.

The connector 1 described above includes the male housing 5 in which the male terminal 4 is provided and that includes the male beak 54 formed to protrude from the outer face, the female housing 7 in which the female terminal 6 to be connected to the male terminal 4 is provided, that can be fit into the male housing 5, and that includes the female lock part 73 that can ride over the male beak 54 to be locked to the male beak 54 while being fit into the male housing 5, and the CPA member 9 that is assembled to the female housing 7, can move from the initial position to the fitting assured position with the female lock part 73 locked to the male beak 54, and includes the CPA lock part 93 that can ride over the male beak 54 and the female lock part 73 locked to the male beak 54 in succession along with the movement from the initial position to the fitting assured position to be locked to the female lock part 73 at the fitting assured position. The male beak 54 includes the male-side lock face 54*b* locking the female lock part 73, the drawing slope surface 54*c* inclining from the protruding tip 54*e* toward the male-side lock face 54*b*, and the protrusion 54*d* protruding from the drawing slope surface 54*c*. The female lock part 73 includes the guide part 73*b* facing the male beak 54 when the female lock part 73 rides on the male beak 54 and the notch 73*c* that is formed in a recessed shape in the guide part 73*b* and can house the protrusion 54*d*.

Consequently, in the connector 1, when the CPA member 9 is moved from the initial position to the fitting assured position with the female lock part 73 locked to the male beak 54, and the CPA lock part 93 is caused to ride over the male beak 54 and the female lock part 73 in this order to be locked to the female lock part 73, the CPA lock part 93 is supported by the protrusion 54*d* protruding from the drawing slope surface 54*c* between the male beak 54 and the female lock part 73, and the CPA lock part 93 can be prevented from being caught between the male beak 54 and the female lock part 73. In this case, in the connector 1, when the male housing 5 and the female housing 7 are fit into each other, and the female lock part 73 rides over the male beak 54 to be locked to the male beak 54, the guide part 73*b* of the female lock part 73 is guided by the drawing slope surface 54*c* of the male beak 54. In this process, the protrusion 54*d* is avoided from coming into contact with the female lock part 73 by the notch 73*c*, and the connector 1 can reduce reduction in the effect of reducing the fitting insertion force between the male housing 5 and the female housing 7 by the drawing slope surface 54*c*. Consequently, the connector 1 can achieve both reduction in the degradation of operation feeling when the CPA member 9 is moved and reduction in the degradation of operation feeling when the male housing 5 and the female housing 7 are fit into each other and can thereby reduce the degradation of operation feeling.

More specifically, in the connector 1 described above, the protrusion 54*d* protrudes within the space SP formed between the protruding tip 54*e* of the male beak 54, the drawing slope surface 54*c*, and the female lock part 73 with the female lock part 73 locked to the male beak 54. Consequently, in the connector 1, when crossing the part of the space SP formed in between the male beak 54 and the female lock part 73, the CPA lock part 93 crosses the part of the space SP while being supported by the protrusion 54*d*, and the CPA lock part 93 is surely prevented from being caught between the male beak 54 and the female lock part 73.

Further, in the connector 1 described above, the female lock part 73 includes the female-side lock face 73*a* to be locked to the male-side lock face 54*b* of the male beak 54, and the notch 73*c* is formed along the direction of the relative movement of the male beak 54 and the female lock part 73 when the female lock part 73 rides over the male beak 54, extends up to the female-side lock face 73*a*, and avoids contact between the female lock part 73 and the protrusion 54*d* along with the relative movement of the male beak 54 and the female lock part 73. Consequently, in the connector 1, the protrusion 54*d* on the drawing slope surface 54*c* is housed in the notch 73*c* in the female lock part 73 guided toward the lock position by the drawing slope surface 54*c*, whereby contact between the female lock part 73 and the protrusion 54*d* can be avoided.

Further, in the connector 1 described above, the CPA lock part 93 comes into contact with the female lock part 73 and is prevented from moving from the initial position to the fitting assured position with the female lock part 73 not locked to the male beak 54 and rides on the male beak 54 to be able to move from the initial position to the fitting assured position with the female lock part 73 locked to the male beak 54. Consequently, the connector 1 can assure that the female lock part 73 has been locked to the male beak 54 and that the male housing 5 and the female housing 7 have been completely fit into each other by the fact that the CPA member 9 has been moved from the initial position to the fitting assured position and can reduce the degradation of operation feeling as described above with this structure.

As illustrated in FIG. 20, FIG. 21, FIG. 22, and the like, the connector 1 of the present embodiment includes an attitude holding rib 55 in the male housing 5 of the male connector 2, thereby reducing inclination between the male housing 5 and the female housing 7. The attitude holding rib 55 is formed inside the hood 51 in the male housing 5, that is, within the fitting space 52. The attitude holding rib 55 is formed to protrude from the inner wall of the hood 51 defining the fitting space 52 and to extend in the axial direction X. To a total of four, or one for each of four corners within the hood 51, attitude holding ribs 55 are provided. With the small-diameter part 71B of the female main body 71 of the female housing 7 fit into the fitting space 52, the attitude holding ribs 55 hold the attitude of the small-diameter part 71B so as to eliminate backlash relative to the outer face of the small-diameter part 71B. This connector 1 can ensure the length in the axial direction X of the attitude holding ribs 55 to be relatively longer within the fitting space 52 of the male housing 5, whereby the attitude holding ribs 55 can come into contact with the female housing 7 through a plurality of places to regulate the attitude at relatively earlier timing of the initial stage of fitting between the male housing 5 and the female housing 7, or at timing before the contact between the male terminal 4 and the female terminal 6, for example. Consequently, the connector 1 can correct relative inclination between the male housing 5 and the female housing 7 by the attitude holding ribs 55 and can hold the attitude of the female housing 7 relative to the male housing 5 with appropriate attitude. With this mechanism, the connector 1 can surely prevent the male terminal 4 and the female terminal 6 from inclining from the appropriate positional relation with the male housing 5 and the female housing 7 completely fit into each other, for example, and can reduce the degradation of operation feeling when the male housing 5 and the female housing 7 are fit into each other also on this point. The connector 1 can hold the attitude of the female housing 7 and the CPA member 9 relative to the male housing 5 with appropriate attitude without via the CPA member 9 and the like, for example, and can achieve miniaturization.

The connector according the embodiment of the present invention described above is not limited to the above embodiment, and various alterations can be made within the range described in what is claimed.

Although the above description is given based on the definition that the first terminal is the male terminal 4, the first housing is the male housing 5, the second terminal is the female terminal 6, and the second housing is the female housing 7, this is not limiting; the first terminal may be a female terminal, the first housing may be a female housing, the second housing may be a male housing, and the second terminal may a male terminal.

Although the above description is given based on the definition that one protrusion 54*d* is formed at substantially the center in the width direction Y in the male beak 54, this is not limiting; a plurality of protrusions 54*d* may be formed, or one for each of both ends in the width direction Y may be formed, for example. In this case, a plurality of notches of the female lock part 73 are also provided in accordance with the number of the protrusions 54*d*.

In the connector according to the embodiments, when the fitting detection member is moved from the initial position to the fitting assured position with the second lock part locked to the first lock part, and the third lock part is caused to ride over the first lock part and the second lock part in this order to be locked to the second lock part, the third lock part is supported by the protrusion protruding from the drawing slope surface between the first lock part and the second lock part, and the third lock part can be prevented from being caught between the first lock part and the second lock part. In this case, in the connector, when the first housing and the second housing are fit into each other, and the second lock part rides over the first lock part to be locked to the first lock part, the guide part of the second lock part is guided by the drawing slope surface of the first lock part. In this process, the protrusion is prevented from coming into contact with the second lock part by the notch, and the connector can reduce reduction in the effect of reducing the fitting insertion force between the first housing and the second housing by the drawing slope surface. Consequently, the connector produces the effect of reducing the degradation of operation feeling.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a first housing provided with a first terminal and including a first lock part formed to protrude from an outer face;

a second housing provided with a second terminal to be connected to the first terminal, configured to be capable of being fit into the first housing, and including a second lock part capable of riding over the first lock part to be locked to the first lock part while being fit into the first housing; and a fitting detection member assembled to the second housing, being capable of moving from an initial position to a fitting assured position with the second lock part locked to the first lock part, and including a third lock part capable of riding over the first lock part and the second lock part locked to the first lock part in succession along with the movement from the initial position to the fitting assured position to be locked to the second lock part at the fitting assured position, wherein the first lock part includes a first lock face locking the second lock part, a drawing slope surface inclining from a side of a protruding tip toward a side of the first lock face, and a protrusion protruding from the drawing slope surface, and the second lock part includes a guide part facing the first lock part when the second lock part rides on the first lock part, and a notch that is formed in a recessed shape in the guide part and is capable of housing the protrusion.

2. The connector according to claim 1, wherein the protrusion protrudes within a space formed between the protruding tip of the first lock part, the drawing slope surface, and the second lock part with the second lock part locked to the first lock part.

3. The connector according to claim 2, wherein the second lock part includes a second lock face to be locked to the first lock face of the first lock part, and the notch is formed along a direction of relative movement of the first lock part and the second lock part when the second lock part rides over the first lock part, extends up to the second lock face, and avoids contact between the second lock part and the protrusion along with the relative movement of the first lock part and the second lock part.

4. The connector according to claim 2, wherein the third lock part comes into contact with the second lock part and is regulated movement thereof from the initial position to the fitting assured position with the second lock part not being locked to the first lock part, and rides on the first lock part to be able to move from the initial position to the fitting assured position with the second lock part being locked to the first lock part.

5. The connector according to claim 1, wherein the third lock part comes into contact with the second lock part and is regulated movement thereof from the initial position to the fitting assured position with the second lock part not being locked to the first lock part, and rides on the first lock part to be able to move from the initial position to the fitting assured position with the second lock part being locked to the first lock part.

6. The connector according to claim 1, wherein the second lock part includes a second lock face to be locked to the first lock face of the first lock part, and the notch is formed along a direction of relative movement of the first lock part and the second lock part when the second lock part rides over the first lock part, extends up to the second lock face, and avoids contact between the second lock part and the protrusion along with the relative movement of the first lock part and the second lock part.

7. The connector according to claim 6, wherein the third lock part comes into contact with the second lock part and is regulated movement thereof from the initial position to the fitting assured position with the second lock part not being locked to the first lock part, and rides on the first lock part to be able to move from the initial position to the fitting assured position with the second lock part being locked to the first lock part.

* * * * *